US008172227B2

(12) United States Patent
Furusawa et al.

(10) Patent No.: US 8,172,227 B2
(45) Date of Patent: May 8, 2012

(54) SHEET DETECTING DEVICE AND IMAGE FORMING APPARATUS

(75) Inventors: Motohiro Furusawa, Suntou-gun (JP); Kenji Watanabe, Suntou-gun (JP); Minoru Kawanishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 12/904,028

(22) Filed: Oct. 13, 2010

(65) Prior Publication Data

US 2011/0089629 A1 Apr. 21, 2011

(51) Int. Cl.
*B65H 7/02* (2006.01)

(52) U.S. Cl. ..... 271/265.01; 271/258.01

(58) Field of Classification Search ..... 271/265.01–265.03, 258.01, 259, 271/261, 227

See application file for complete search history.

(56) References Cited

U.S. PATENT DOCUMENTS

| | | | | |
|---|---|---|---|---|
| 4,395,035 | A * | 7/1983 | Hunt | 271/97 |
| 5,204,726 | A * | 4/1993 | Choi | 399/21 |
| 5,651,538 | A | 7/1997 | Chung | |
| 5,923,140 | A | 7/1999 | Azumi | |
| 2010/0148431 | A1 * | 6/2010 | Otsuka et al. | 271/265.01 |

FOREIGN PATENT DOCUMENTS

| | | | |
|---|---|---|---|
| JP | 06-094444 | A | 4/1994 |
| JP | 08-113388 | A | 5/1996 |
| JP | 08-224924 | A | 9/1996 |
| JP | 10-114446 | A | 5/1998 |

* cited by examiner

*Primary Examiner* — Kaitlin Joerger
*Assistant Examiner* — Prasad Gokhale
(74) *Attorney, Agent, or Firm* — Canon USA, Inc IP Division

(57) ABSTRACT

A sheet detecting device includes a rotation unit having an abutment surface, a positioning unit configured to position the rotation unit in a standby position where the leading edge of the conveyed sheet abuts the abutment surface, and a detecting unit configured to detect the conveyed sheet on the basis of the rotation of the rotation unit pressed by the conveyed sheet, wherein the rotation unit rotates to a sheet passage posture where the sheet is allowed to pass after being pressed by the leading edge of the conveyed sheet and, when the trailing edge of the conveyed sheet passes the rotation unit, the rotation unit is rotated from the sheet passage posture in the same direction as a sheet conveying direction and is positioned in the standby position.

10 Claims, 22 Drawing Sheets

FIG. 5A1
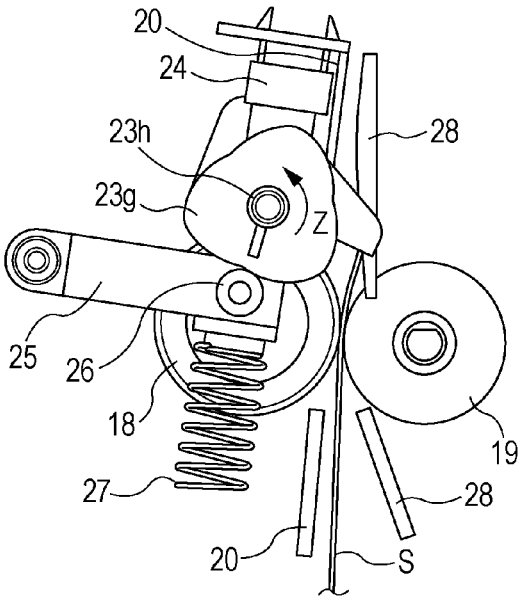
FIG. 5B1
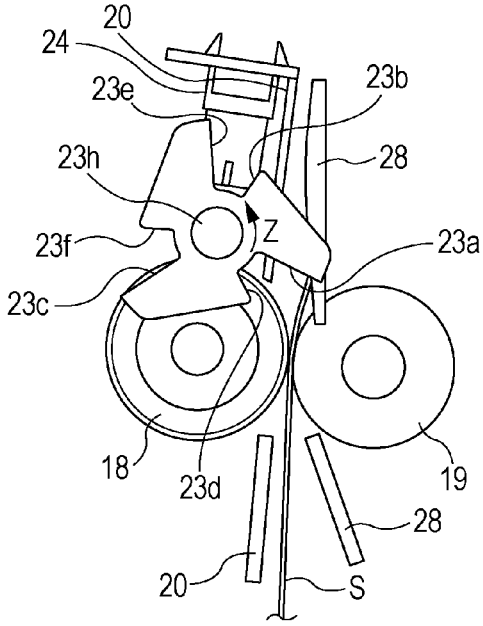
FIG. 5A2
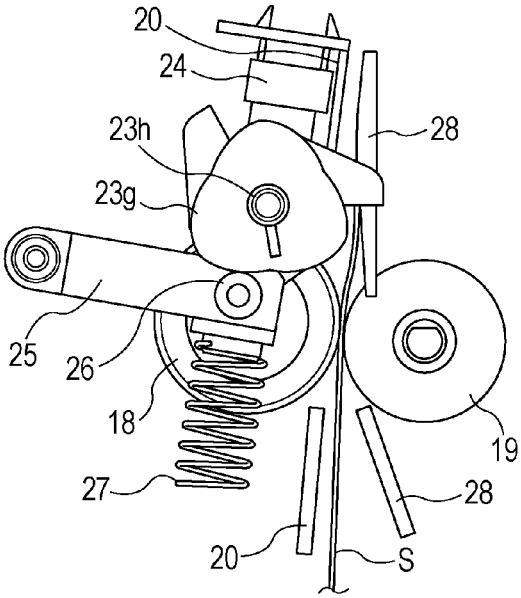
FIG. 5B2
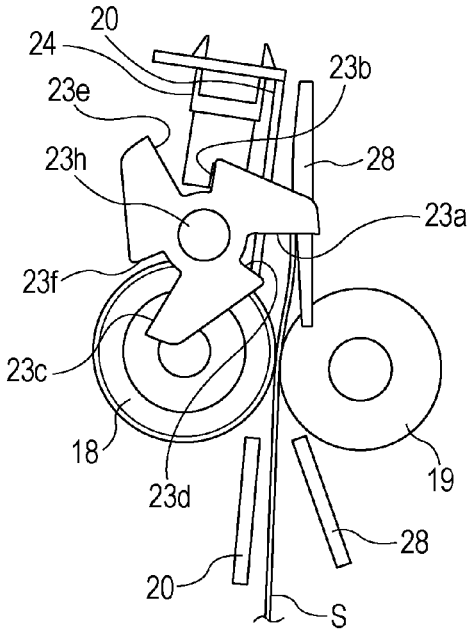

FIG. 6A1
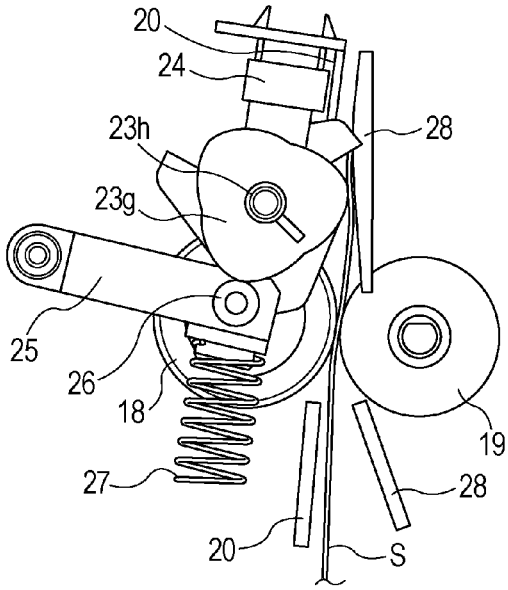
FIG. 6B1
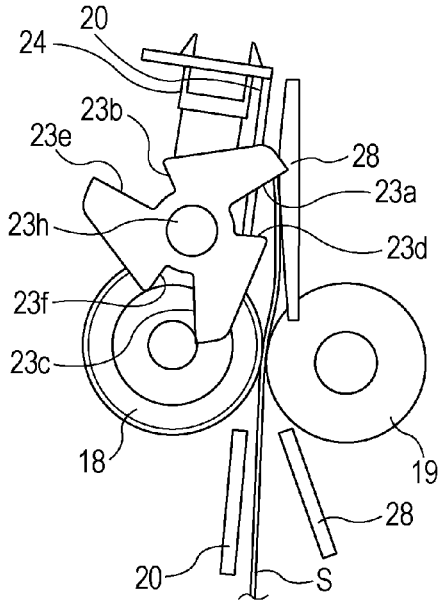
FIG. 6A2
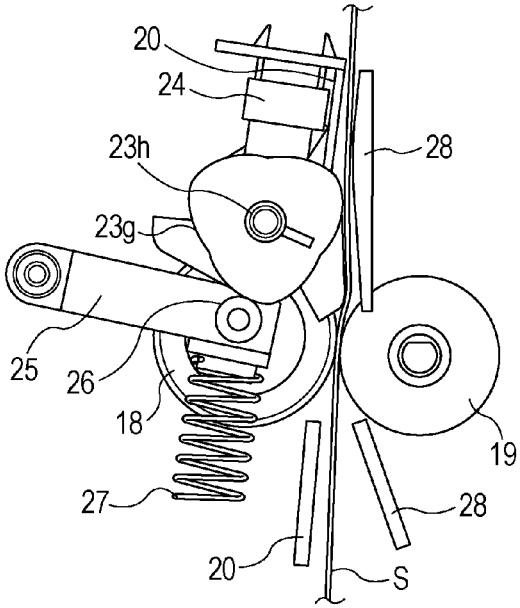
FIG. 6B2
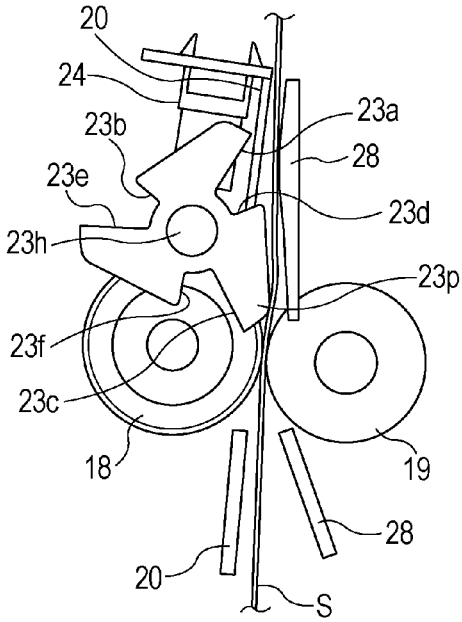

FIG. 7A1
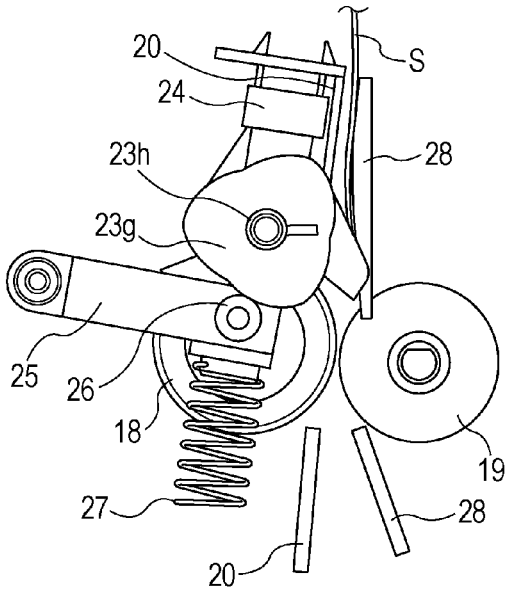
FIG. 7B1
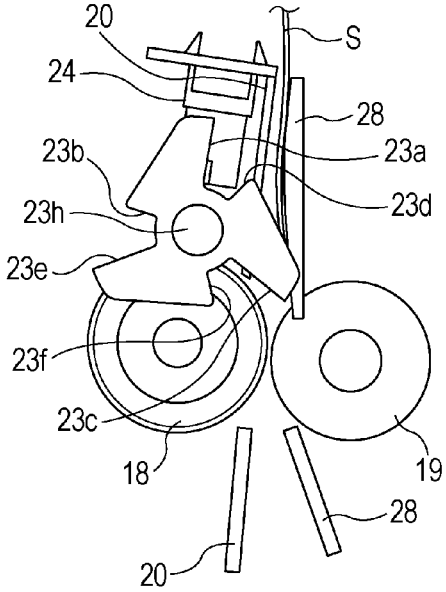
FIG. 7A2
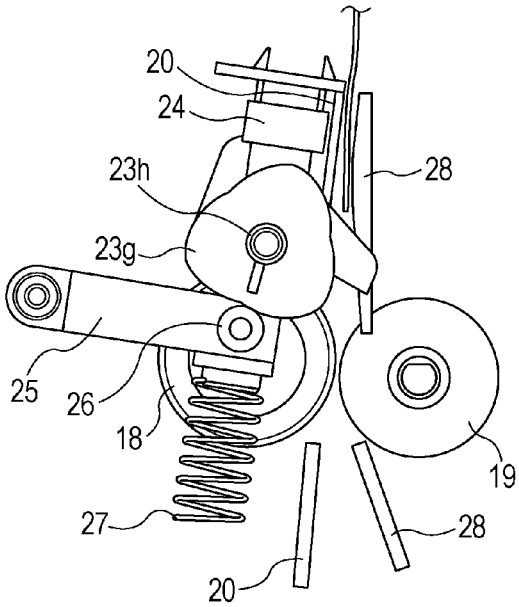
FIG. 7B2
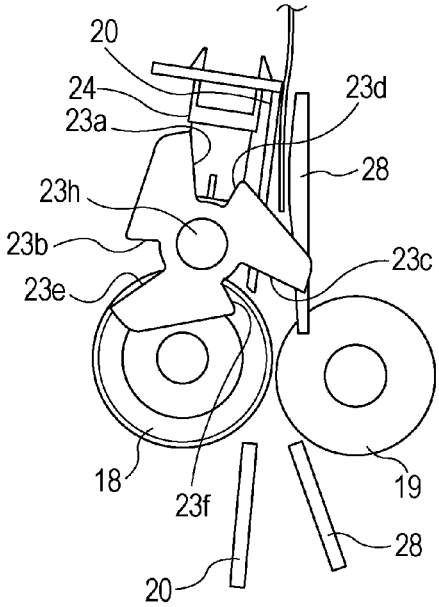

FIG. 9A
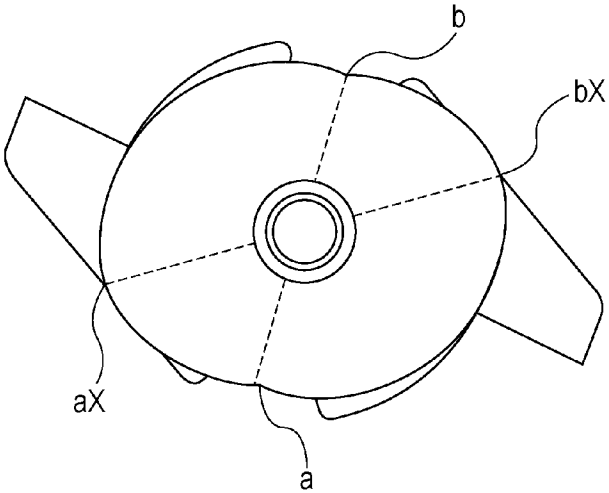
FIG. 9B
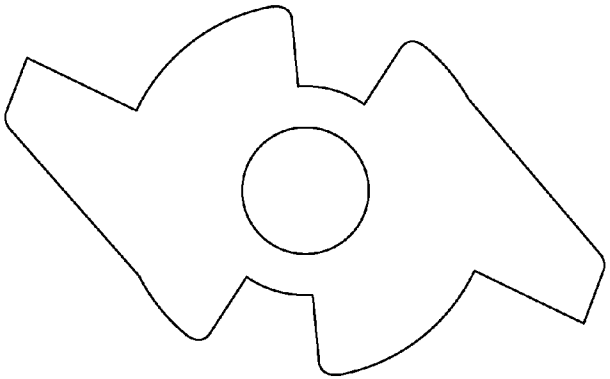
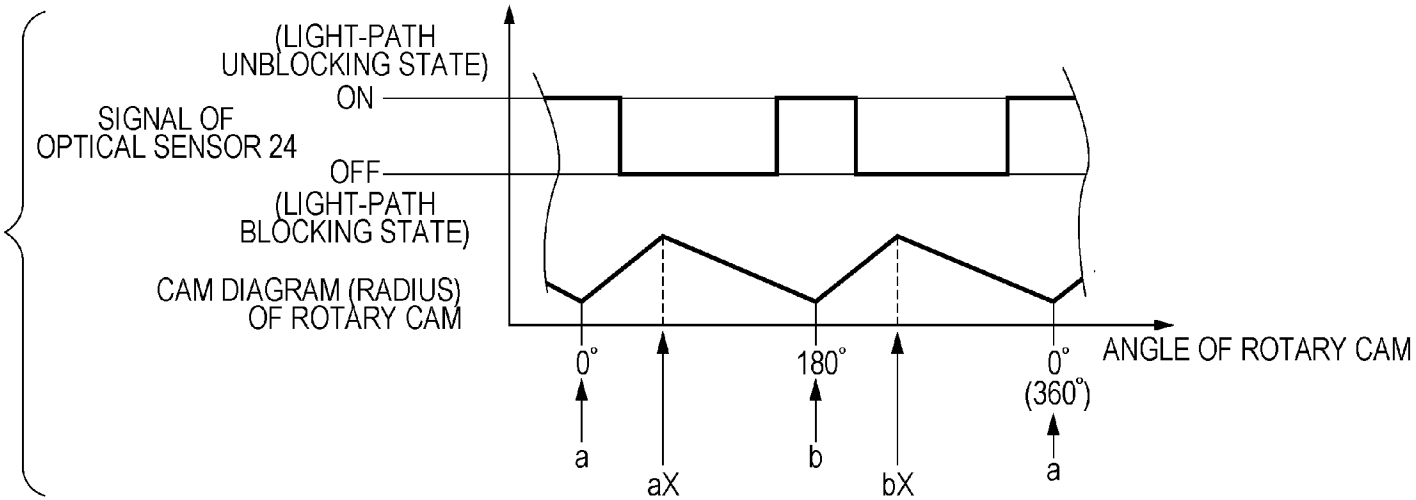
FIG. 9C

FIG. 10A
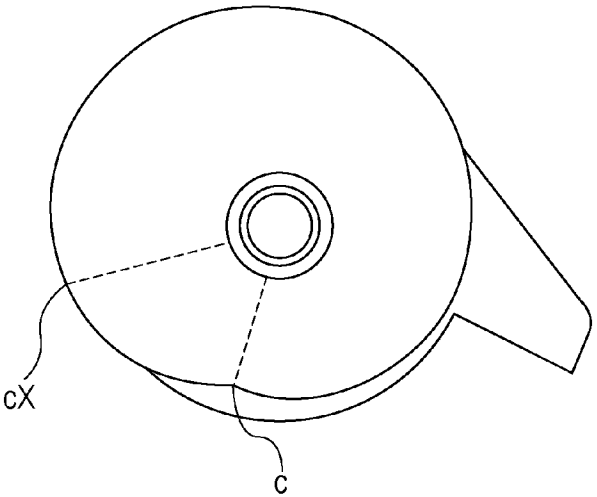
FIG. 10B
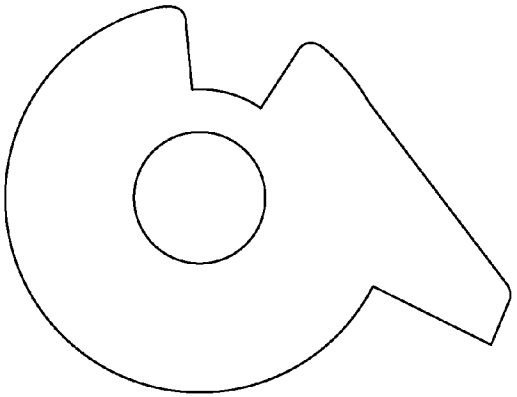
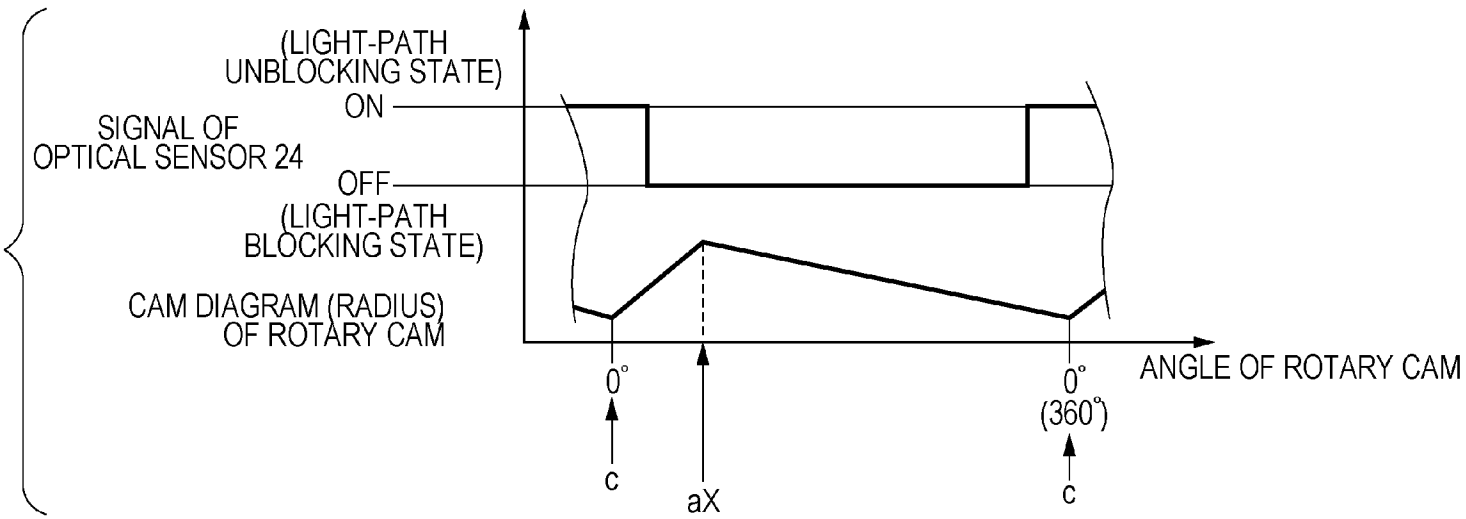
FIG. 10C

SHEET DETECTING DEVICE AND IMAGE FORMING APPARATUS

TECHNICAL FIELD

The present invention relates to a sheet detecting device provided to detect a moving state of a sheet and an image forming apparatus including the same.

BACKGROUND ART

As illustrated in FIGS. 22A to 22C, a sheet detecting device including a flag 223 and a sensor 224 for detecting a sheet conveyed through a pair of sheet conveying rollers 218 and 219 is disposed downstream of the pair of sheet conveying rollers 218 and 219 in a sheet conveying direction.

The flag 223 includes a shaft 227 which serves as the center of rotation of the flag 223 and a light-shielding member 225 which shields a light path from a light-emitting portion to a photo detector in the sensor 224. The flag 223 further includes a stopper portion 226. As illustrated in FIG. 22A, the flag 223 is urged clockwise by a spring or the like. The stopper portion 226 of the flag 223 is in contact with a stopper 226*a* of an apparatus frame, thereby restricting the rotation of the flag 223. Thus, the flag 223 is held in a standby position.

As illustrated in FIG. 22B, when the leading edge of a sheet, conveyed through the pair of sheet conveying rollers 218 and 219, abuts a contact surface 223*a* of the flag 223, the flag 223 begins swinging about the shaft 227 in the direction, indicated by the arrow in FIG. 22B, from the standby position. As illustrated in FIG. 22C, the light-shielding member 225 shields the light path from light and the sensor 224 detects the light-shielding and outputs a signal. On the basis of this signal, the sheet detecting device detects that the leading edge of the sheet has been conveyed to an area corresponding to the flag 223. When the trailing edge of the sheet passes the area corresponding to the flag 223, the flag 223 again swings to the standby position illustrated in FIG. 22A and is ready to detect the next sheet.

In other words, the flag 223 reciprocates between the standby position and a position where the flag 223 pressed by a sheet allows the sheet to pass each time the sheet passes (refer to Patent Literatures 1 and 2).

A result of detection by the above-described sheet detecting device is used as follows, for example. In an image forming apparatus for forming an image on a sheet, the timing when a sheet conveying unit conveys a sheet to an image transfer unit is adjusted on the basis of the result of detection by the sheet detecting device so that an image formed by an image forming unit is formed in a predetermined position of the sheet. The timing when the image forming unit starts image formation is adjusted on the basis of the result of detection by the sheet detecting device so that an image formed by the image forming unit is formed in the predetermined position of the sheet. In addition, the result of detection by the sheet detecting device is used to detect, for example, a delay in sheet conveyance or a jam in a sheet conveying path.

CITATION LIST

Patent Literature

PTL 1 Japanese Patent Laid-Open No. 6-94444

PTL 2 Japanese Patent Laid-Open No. 10-114446

In response to user demands for further increased productivity (the number of image-formed sheets per unit time) of the image forming apparatus, an increase of sheet conveying speed or a reduction of the interval (hereinafter, referred to as "sheet interval") between the trailing edge of a preceding sheet and the leading edge of a succeeding sheet is being desired. Accordingly, the flag is required to again return to the standby position for aligning the leading edge of the succeeding sheet in a short sheet interval after the trailing edge of the preceding sheet passes.

As described above, in the related-art sheet detecting device, the flag reciprocates each time a sheet passes. Therefore, the following distance is needed as a minimum distance required as the sheet interval. A distance D1 is set as a distance in which the contact surface 223*a* of the flag 223 returns from the position of the contact surface 223*a* located when the trailing edge of the preceding sheet passes the contact surface 223*a* of the flag 223, as illustrated in FIG. 22C, to the standby position where the contact surface 223*a* aligns the leading edge of the succeeding sheet, as illustrated in FIG. 22A. A distance D2 is set as a distance where the succeeding sheet is conveyed while the contact surface 223*a* returns from the position of the contact surface 223*a* located when the trailing edge of the preceding sheet passes the contact surface 223*a* of the flag 223 to the standby position. The minimum distance required as the sheet interval between the preceding sheet and the succeeding sheet is a distance D3 (D1+D2=D3) obtained by adding the distance D1 and the distance D2. Specifically, when the sheet interval is shorter than this distance, the succeeding sheet reaches the standby position before the contact surface 223*a* of the flag 223 returns to the standby position. Disadvantageously, the sheet cannot be detected.

To increase the productivity of the image forming apparatus, the sheet conveying speed may be increased in addition to the reduction of the sheet interval. However, the increase of the sheet conveying speed causes the following problem.

The distance D2 in which the succeeding sheet is conveyed during a returning operation of the flag is calculated by multiplying the time $\Delta T$ during which the flag 223 returns from the position illustrated in FIG. 22C to the standby position in FIG. 22A while rotating in the direction opposite to the sheet conveying direction by a sheet conveying speed V ($\Delta T \times V = D2$). Accordingly, the higher the sheet conveying speed, the longer the distance D2 needed. As described above, as the sheet conveying speed is increased, the minimum distance required as the sheet interval has to be set longer. It is difficult to substantially increase the productivity.

In the sheet detecting device using the reciprocating flag, therefore, the increase of the productivity (the number of conveyed sheets per unit time) related to sheet conveyance is restricted because it is limited by the time for return of the flag.

SUMMARY OF INVENTION

The present invention provides a sheet detecting device capable of reducing the sheet interval between sheets and an image forming apparatus including the same.

The present invention provides a sheet detecting device including a rotation unit having an abutment surface, the rotation unit being pressed and rotated by the leading edge of a conveyed sheet when the leading edge of the conveyed sheet abuts the abutment surface, a positioning unit configured to position the rotation unit in a standby position where the leading edge of the conveyed sheet abuts the abutment surface, and a detecting unit configured to detect the conveyed sheet on the basis of the rotation of the rotation unit pressed by the conveyed sheet, wherein the rotation unit rotates to a sheet passage posture where the sheet is allowed to pass after being pressed by the leading edge of the conveyed sheet and, when the trailing edge of the conveyed sheet passes the rotation unit, the rotation unit is rotated from the sheet passage posture in the same direction as a sheet conveying direction and is positioned in the standby position.

Further features of the present invention will become apparent from the following description of exemplary embodiments with reference to the attached drawings.

BRIEF DESCRIPTION OF DRAWINGS

FIGS. 5A1 to 5B2 are diagrams explaining the operation of the sheet detecting device according to the first embodiment.

FIGS. 6A1 to 6B2 are diagrams explaining the operation of the sheet detecting device according to the first embodiment.

FIGS. 7A1 to 7B2 are diagrams explaining the operation of the sheet detecting device according to the first embodiment.

FIGS. 9A to 9C are explanatory diagrams explaining a modification of the first embodiment.

FIGS. 10A to 10C are explanatory diagrams explaining another modification of the first embodiment.

DESCRIPTION OF EMBODIMENTS

First Embodiment

Figure 1:
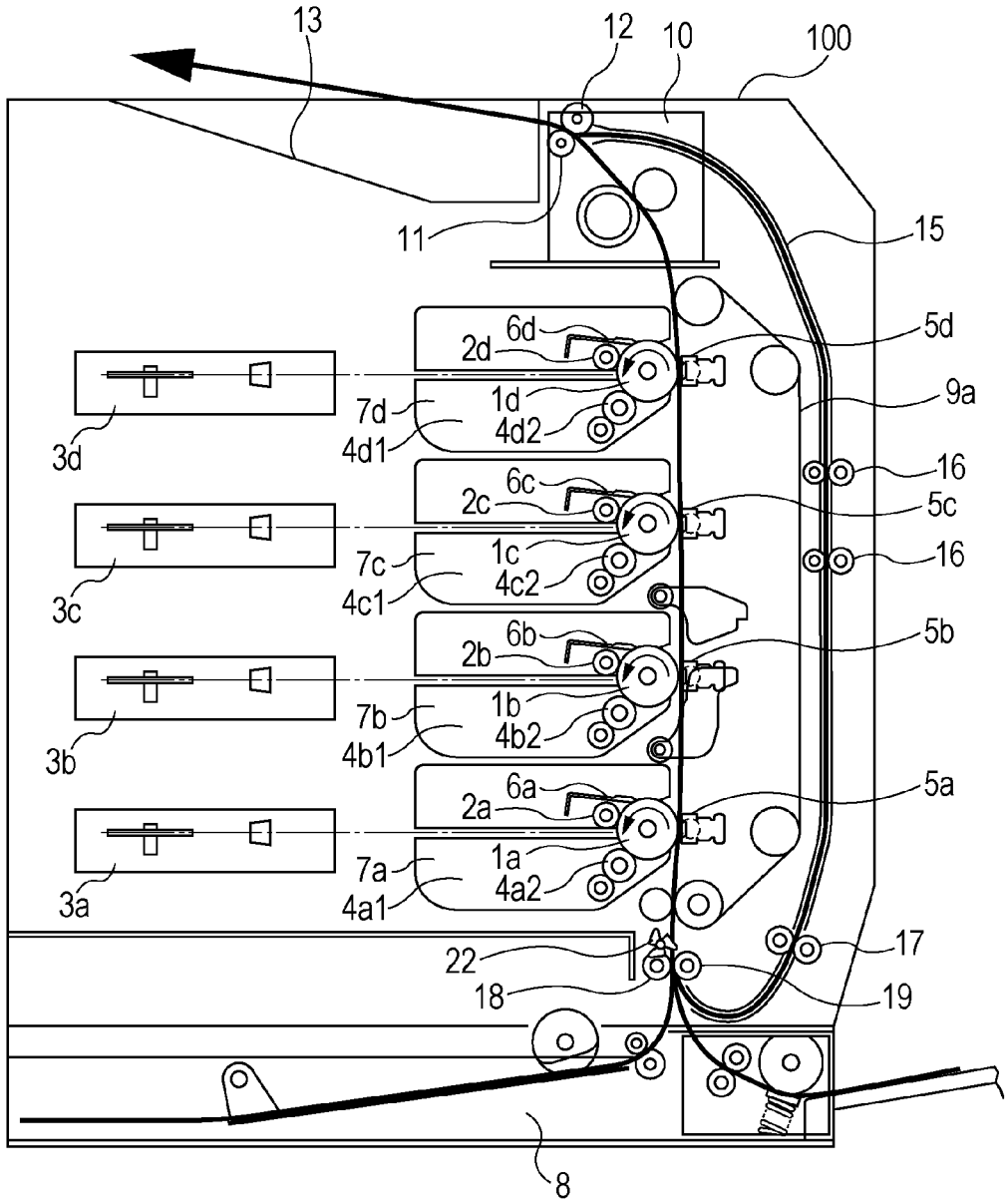
FIG. 1 is a cross-sectional view explaining a sheet detecting device and an image forming apparatus including the same according to a first embodiment of the present invention.

Embodiments of the present invention will be described below with reference to the drawings. Components common to the drawings are designated by the same reference numerals. FIG. 1 is a cross-sectional view illustrating the schematic structure of a color printer, serving as an example of an image forming apparatus including a sheet detecting device according to a first embodiment of the present invention. The present embodiment will be described with respect to the color image forming apparatus which is of an electrophotographic type and which forms toner images of four different colors.

Referring to FIG. 1, the image forming apparatus 100 according to the present embodiment includes four photosensitive drums 1*a* to 1*d*, serving as image bearing members. In addition, charging units 2*a* to 2*d* each uniformly charging the surface of the drum and exposure units 3*a* to 3*d* each emitting a laser beam on the basis of image information to form an electrostatic latent image on the photosensitive drum 1 are arranged around the photosensitive drums 1. Furthermore, developing units 4*a* to 4*d* each applying toner to the latent image to form a toner image and transfer members 5*a* to 5*d* each transferring the toner image on the photosensitive drum 1 onto a sheet are arranged. The photosensitive drums 1*a* to 1*d*, the exposure units 3*a* to 3*d*, the developing units 4*a* to 4*d*, and the transfer members 5*a* to 5*d* constitute an image forming unit.

In addition, cleaning units 6*a* to 6*d* each removing toner remaining on the surface of the photosensitive drum 1 after transfer and the like are arranged. In the present embodiment, the photosensitive drums 1, the charging units 2, the developing units 4, and the cleaning units 6 removing toner integrally constitute process cartridges 7*a* to 7*d*.

Each photosensitive drum 1, serving as the image bearing member, is formed by applying an organic photoconductor layer (OPC) onto the outer surface of a cylinder made of aluminum. Both ends of the photosensitive drum 1 are rotatably supported by a flange. Driving force is transmitted from a driving motor (not illustrated) to the one end, so that the photosensitive drum 1 is rotated counterclockwise in the figure.

Each charging unit 2 is a roller-shaped conductive member. This roller is brought into contact with the surface of the photosensitive drum 1 and is applied with a charging bias voltage by a power supply (not illustrated), so that the surface of the photosensitive drum 1 is uniformly charged. Each exposure unit 3 includes a polygon mirror. This polygon mirror is irradiated with image light corresponding to an image signal from a laser diode (not illustrated). As for the light emission start timing of the laser diode, the timing when the above-described sheet detecting device, indicated at 22, detects the leading edge of a sheet S is the starting point.

The developing units 4 include, for example, toner storage portions 4*a*1, 4*b*1, 4*c*1, and 4*d*1 and developing rollers 4*a*2, 4*b*2, 4*c*2, and 4*d*2. The toner storage portions 4*a*1 to 4*d*1 store different color toners of black, cyan, magenta, and yellow, respectively. The developing rollers 4*a*2 to 4*d*2 adjacent to the surfaces of the photosensitive drums are rotated and applied with a developing bias voltage to perform developing.

A transfer belt 9*a* for conveying a sheet upward is disposed so as to face the four photosensitive drums 1*a* to 1*d*. Within the transfer belt 9*a*, the transfer members 5*a* to 5*d* in contact with the transfer belt 9*a* are arranged so as to face the four photosensitive drums 1*a* to 1*d*, respectively. These transfer members 5 are connected to a transfer bias power supply (not illustrated). Positive charge is applied from each transfer member 5 through the transfer belt 9*a* to a sheet S. This electric field allows negative different color toner images on the photosensitive drums 1 to be sequentially transferred onto the sheet S in contact with the photosensitive drum 1, so that a color image is formed.

A fixing unit 10 for fixing toner images, which have been transferred on a sheet, onto the sheet is disposed above the transfer belt 9*a*. A pair of discharge rollers 11 and 12 for discharging the sheet with the formed image to a discharge unit 13 is arranged in an upper portion of the fixing unit 10.

In a lower portion of the image forming apparatus 100, a feeding unit 8 for feeding sheets from a bundle of stacked sheets one by one is disposed. The feeding unit 8 feeds sheets from the bundle of stacked sheets one by one to the transfer belt 9*a*. A pair of conveying rollers 18 and 19, serving as a pair of rotary members, is arranged between the feeding unit 8 and the transfer belt 9*a*. In addition, the sheet detecting device 22 for detecting the arrival of a sheet is disposed between the feeding unit 8 and the transfer belt 9*a*. The structure of the sheet detecting device 22 will be described in detail later.

Reference numeral 15 denotes a duplex conveying path that connects the pair of discharge rollers 11 and 12 and the pair of conveying rollers 18 and 19. On the duplex conveying path 15, oblique-feed rollers 16 and U-turn rollers 17 are arranged.

A sheet S set in the feeding unit 8 is fed from the feeding unit 8 in accordance with a print start instruction. When the leading edge of the fed sheet S reaches the sheet detecting device 22, the sheet detecting device 22 detects the leading edge of the sheet S. On the basis of the result of detection by the sheet detecting device 22, an instruction to start image formation on each photosensitive drum 1 in the image forming unit is given.

The sheet fed from the feeding unit 8 is conveyed to the transfer belt 9*a* by the pair of conveying rollers 18 and 19. While the sheet is being conveyed by the transfer belt 9*a*, toner images formed on the photosensitive drums 1*a* to 1*d* are sequentially transferred onto the sheet by the operations of the transfer members 5*a* to 5*d*. The sheet with the transferred toner images is subjected to image fixing by the fixing unit 10 and is then discharged to the discharge unit 13 through the pair of discharge rollers 11 and 12.

To form images on both sides of the sheet, while the sheet is being conveyed by the pair of discharge rollers 11 and 12, the pair of discharge rollers 11 and 12 is reversed, so that the sheet is conveyed to the duplex conveying path 15 by the pair of discharge rollers 11 and 12. The sheet S conveyed on the duplex conveying path 15 passes the oblique-feed rollers 16 and is again conveyed to the transfer belt 9*a* by the U-turn rollers 17 and the pair of conveying rollers 18 and 19. An image is formed on a second side of the sheet.

Figure 2:
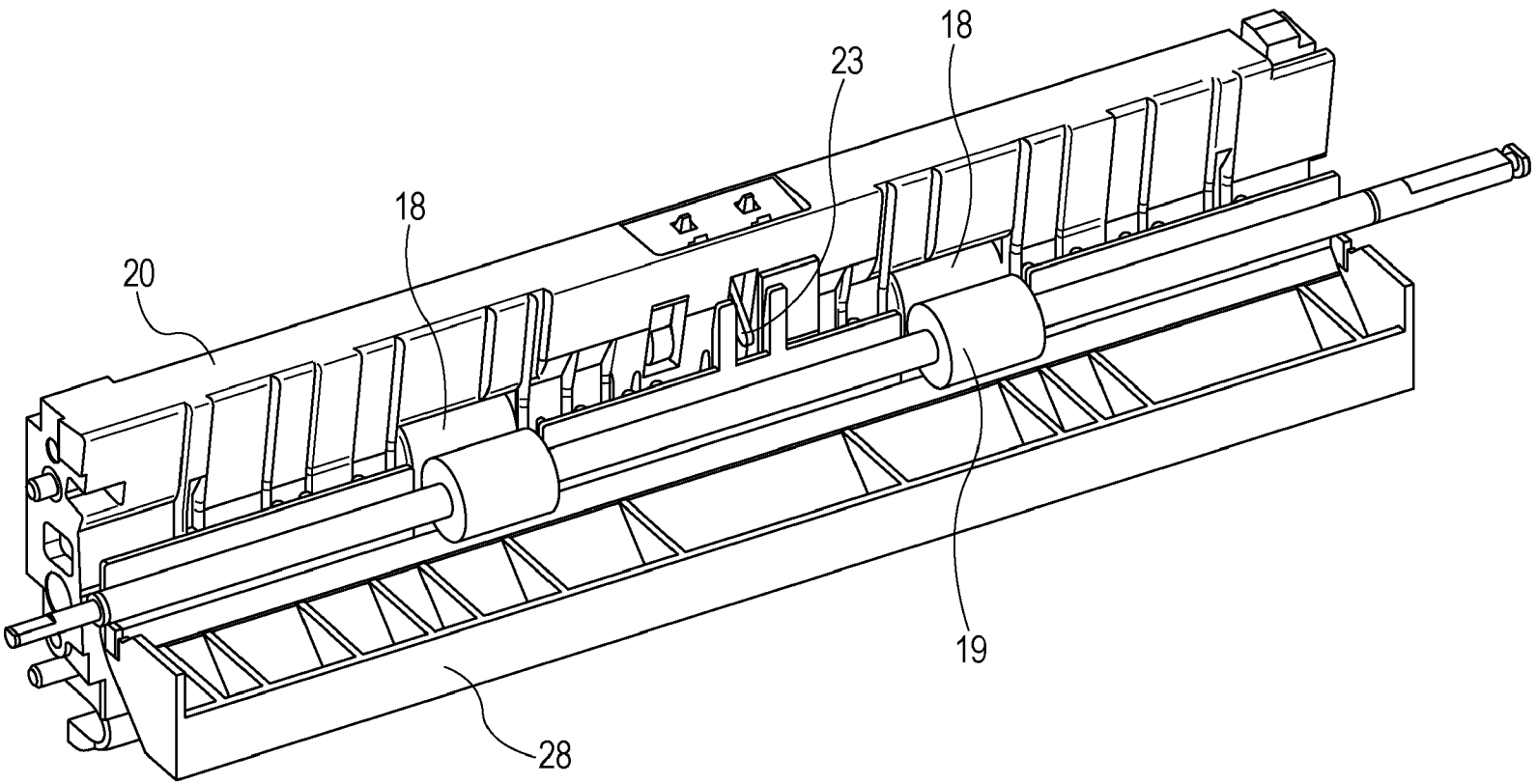
FIG. 2 is a perspective view illustrating the structure of the sheet detecting device according to the first embodiment.
Figure 3A:
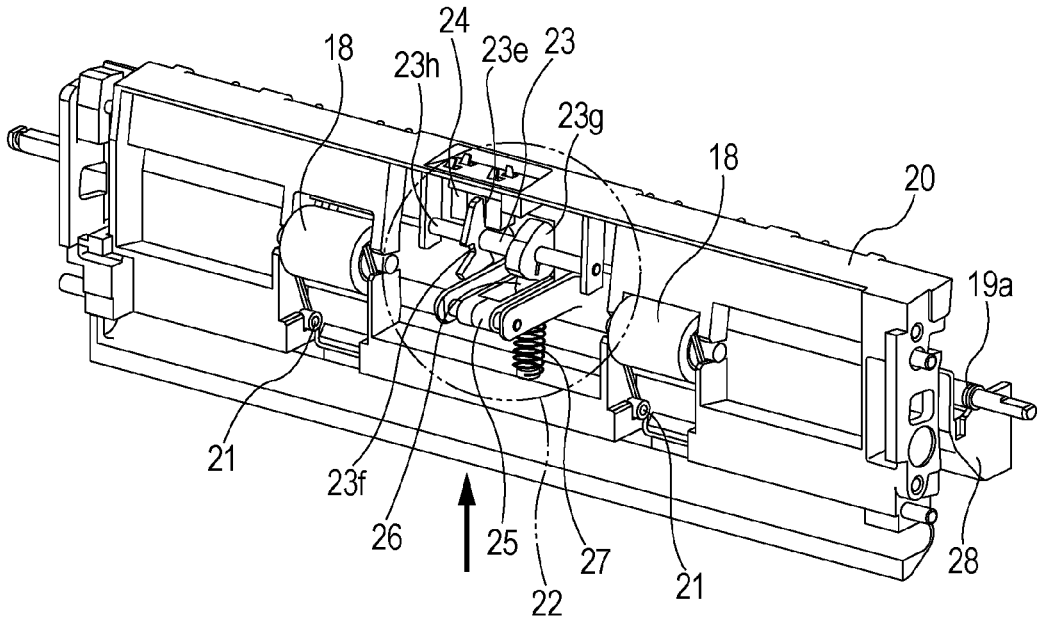
FIGS. 3A and 3B are perspective views illustrating the structure of the sheet detecting device according to the first embodiment.
Figure 3B:
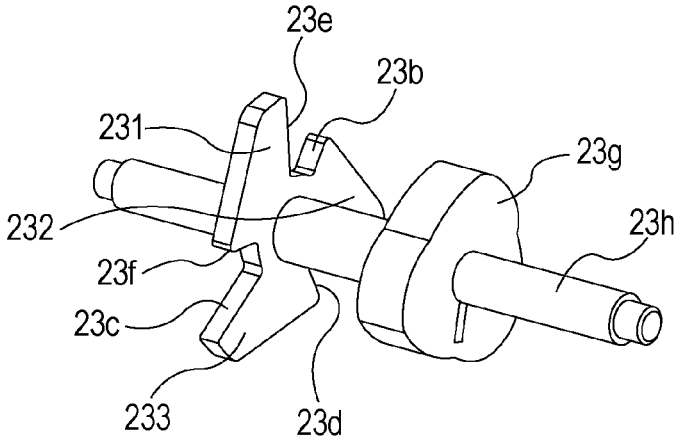

The structure of the sheet detecting device 22 according to the present embodiment incorporated in the image forming apparatus 100 will now be described with reference to FIGS. 2 and 3. FIG. 2 is a perspective view illustrating the structure of the sheet detecting device 22 according to the present embodiment. FIG. 3A is a perspective view of the structure of the sheet detecting device 22 illustrated in FIG. 2 as viewed from the opposite side thereof. FIG. 3B is a perspective view illustrating only a sensor flag member 23. The arrow in FIG. 3A indicates the sheet conveying direction.

Referring to FIG. 2, the pair of conveying rollers 18 and 19 includes the driving roller 19 which is fixed to a rotation shaft 19*a* extending in the direction perpendicular to the sheet conveying direction so as to rotate together with the rotation shaft 19*a* and the conveying driven roller 18 which is disposed so as to face the driving roller 19 and is driven and rotated by the driving roller 19. The conveying driven roller 18 is rotatably supported by a sheet feeding frame 20. The conveying driven roller 18 is a driven rotary member for conveying a sheet S. As illustrated in the perspective view of FIG. 3A, the conveying driven roller 18 is urged against the driving roller 19 by a conveying driven roller spring 21 fixed to the sheet feeding frame 20. This urging force provides force for conveying a sheet S.

The sheet detecting device 22 according to the present embodiment is disposed downstream of the nip between the pair of conveying rollers 18 and 19 so as to detect the leading edge of a sheet.

As illustrated in the perspective view of FIG. 3A, the sheet detecting device 22 includes the sensor flag member 23, an optical sensor 24, a pressing member 25, a cam follower 26, and a pressing spring 27.

The sensor flag member 23, serving as a rotation unit, includes a rotation shaft 23*h* which rotates while being supported by holes formed in the sheet feeding frame 20. The sensor flag member 23 is supported by the sheet feeding frame 20 so as to be rotatable about the rotation shaft 23*h*. As illustrated in FIG. 3B depicting only the sensor flag member 23, the sensor flag member 23 has three protrusions 231, 232, and 233 which protrude from the rotation shaft 23*h* in the direction orthogonal to the axial direction of the rotation shaft 23*h*.

Figure 4A:
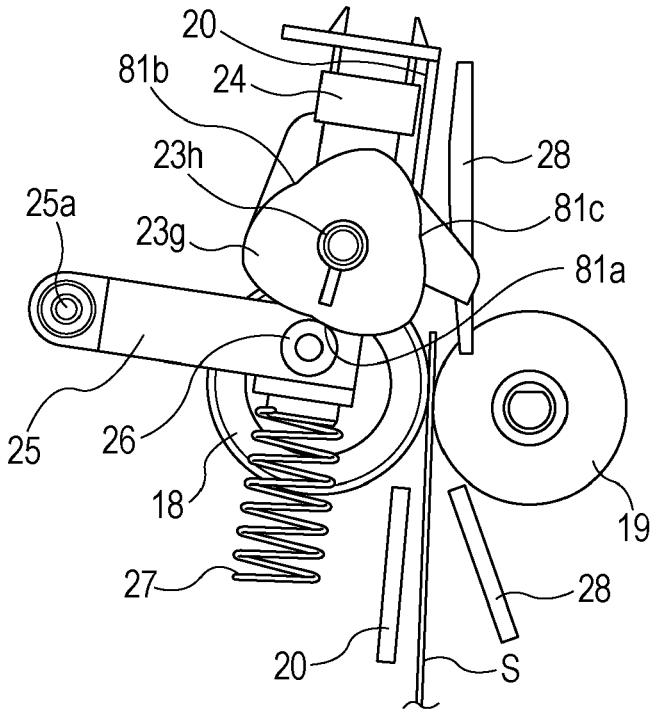
FIGS. 4A and 4B are diagrams explaining an operation of the sheet detecting device according to the first embodiment.
Figure 4B:
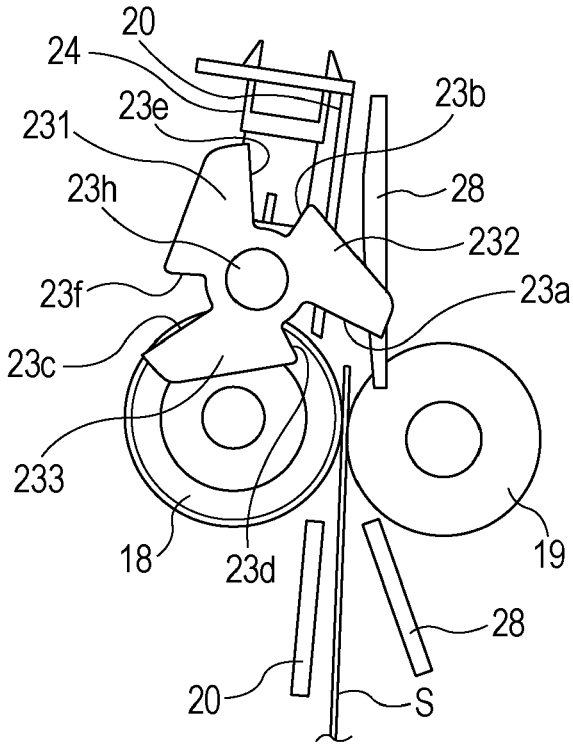

A cross-sectional view of FIG. 4B is taken along the protrusions 231, 232, and 233 in the sensor flag member 23. The protrusions 231, 232, and 233 have abutment surfaces 23*a*, 23*c*, 23*e* which the leading edges of conveyed sheets S are to abut, respectively. In other words, the abutment surfaces 23*a*, 23*c*, and 23*e* are arranged in the circumferential direction of the rotation shaft 23*h*.

The protrusions 231, 232, and 233 of the sensor flag member 23 are configured to block a light path of the optical sensor 24, serving as a detecting unit. The sensor flag member 23 is configured to detect the arrival of a conveyed sheet when the light path of the optical sensor 24 is blocked by any of light-shielding edges 23*b*, 23*d*, and 23*f* in the protrusions 231, 232, and 233. Specifically, any of the protrusions 231, 232, and 233 of the sensor flag member 23 blocks the light path of the optical sensor 24, thus changing an ON state of the optical sensor 24 to an OFF state. The sheet detecting device detects the arrival (position) of a sheet on the basis of an output from the optical sensor 24.

As illustrated in the perspective views of FIGS. 3A and 3B, the rotation shaft 23*h* is provided with a rotary cam 23*g* for generating holding force by which the sensor flag member 23 is held in a standby position and rotating force of the sensor flag member 23. The rotary cam 23*g* is configured to position the sensor flag member 23 in a rotating direction and sets any of the abutment surfaces 23*a*, 23*c*, and 23*e* of the sensor flag member 23 to a proper position where the leading edge of a sheet abuts the abutment surface. FIG. 4A is a cross-sectional view taken along the rotary cam 23*g* in the sensor flag member 23. The rotary cam 23*g* is a triangle in profile and each apex is arcuate. Sides of the rotary cam 23*g* have depressions 81*a*, 81*b*, and 81*c*, respectively. The rotary cam 23*g* is pressed by the pressing member 25. The pressing member 25 is journaled by the sheet feeding frame 20 so as to be able to swing about a swing shaft 25*a*. The pressing spring 27 is disposed such that one end of the pressing spring 27 is secured to the sheet feeding frame 20 and the other end thereof is attached to the pressing member 25. The spring force of the pressing spring 27 urges the pressing member 25 against the rotary cam 23*g*. The end of the pressing member 25 is provided with the cam follower 26 rotatably journaled in the pressing member 25. The rotary cam 23*g* is in contact with the cam follower 26 of the pressing member 25 at all times. The spring force of the pressing spring 27 allows the cam follower 26 to press the rotary cam 23*g*.

The rotary cam 23*g* is shaped so that the sensor flag member 23 is held in a steady position (steady state) in the rotating direction, as illustrated in FIGS. 4A and 4B, when the spring force of the pressing spring 27 allows the cam follower 26 to urge the rotary cam 23*g*. When the sensor flag member 23 is located in such a standby position (steady position), the cam follower 26 faces any of the depressions 81*a*, 81*b*, and 81*c* of the rotary cam 23*g*. Specifically, since the cam follower 26 urged by the spring force of the pressing spring 27 is in contact with any of the depressions 81*a*, 81*b*, and 81*c* of the rotary cam 23*g*, the sensor flag member 23 is held in the standby position by the spring force of the pressing spring 27. In other words, the cam follower 26 urged by the pressing spring 27, the depressions 81*a*, 81*b*, and 81*c* of the rotary cam 23*g*, and the like constitute a positioning unit for positioning the sensor flag member 23 in the steady position. The end of the pressing member may be come into contact with the periphery of the rotary cam 23*g*.

An operation of the sheet detecting device will be described with reference to FIGS. 4A to 8.

Figure 8:
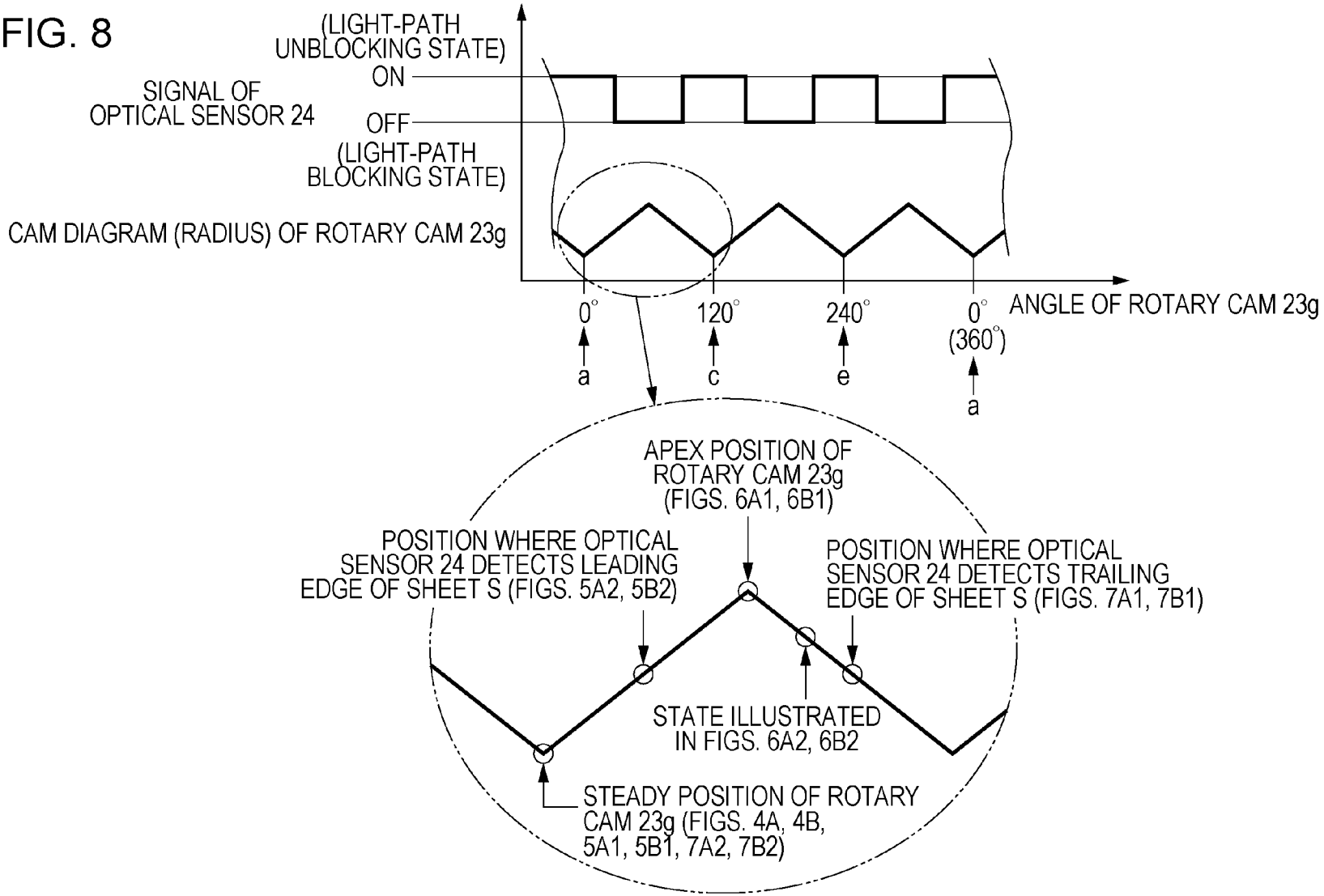
FIG. 8 includes a cam diagram of the sheet detecting device according to the first embodiment and an explanatory diagram illustrating a signal of an optical sensor.

FIGS. 4A to 7B2 illustrate a process of conveying a sheet to be detected by the sheet detecting device. FIGS. 4A, 5A1, 5A2, 6A1, 6A2, 7A1, and 7A2 illustrate rotation states of the rotary cam 23*g*. FIGS. 4B, 5B1, 5B2, 6B1, 6B2, 7B1, and 7B2 illustrate the positions of the abutment surfaces 23*a*, 23*c*, and 23*e* and those of the light-shielding edges 23*b*, 23*d*, and 23*f*. FIG. 8 includes a cam diagram of the rotary cam 23*g* in the states of FIGS. 4A to 7B2 and also illustrates a signal from the optical sensor 24.

FIGS. 4A and 4B are diagrams illustrating a state just before the leading edge of a sheet S abuts the abutment surface 23*a* of the sensor flag member 23. As illustrated in FIG. 4A, the sensor flag member 23 is on standby in the steady position for detecting the leading edge of the sheet S while being urged by the rotary cam 23*g*, the pressing member 25, and the pressing spring 27. In this steady position, the light path of the optical sensor 24 is not blocked by the sensor flag member 23, as illustrated in FIG. 4B.

FIGS. 5A1 and 5B1 illustrate a state where the leading edge of the sheet S, conveyed by the pair of conveying rollers 18 and 19, abuts the abutment surface 23*a*. The leading edge of the sheet S rotates the sensor flag member 23 in the Z direction in the figure due to the conveying force of the pair of conveying rollers 18 and 19. At this time, the sheet is conveyed while the leading edge of the sheet S is rotating the sensor flag member 23 against the holding force (force tending to hold the rotary cam 23*g* in the steady position) of the rotary cam 23*g* urged by the pressing spring 27. The leading edge of the sheet S is guided to the sensor flag member 23 by a conveying guide composed of the sheet feeding frame 20 and a guide frame 28. This prevents the leading edge of the sheet S from slipping away from the abutment surface 23*a* of the sensor flag member 23. Thus, the sensor flag member 23 can be reliably rotated by the leading edge of the sheet S.

FIGS. 5A2 and 5B2 illustrate a state where the sensor flag member 23 is pressed by the conveyed sheet S and is further rotated. As illustrated in FIG. 5B2, the sensor flag member 23 is rotated so that the light-shielding edge 23*b* blocks the light path of the optical sensor 24. When the light path of the optical sensor 24 is blocked by the light-shielding edge 23*b* of the sensor flag member 23, the optical sensor 24 detects that the leading edge of the sheet S has reached a predetermined position (refer to FIG. 8). In the present embodiment, the image forming unit starts image formation on the basis of the fact that the sheet detecting device 22 has detected the leading edge of the sheet S.

FIGS. 6A1 and 6B1 illustrate a state where the sensor flag member 23 is further rotated by the conveyed sheet S after the state illustrated in FIGS. 5A2 and 5B2. FIGS. 6A1 and 6B1 illustrate the state where the sensor flag member 23 is rotated to a position where the apex (angular portion) of the rotary cam 23*g* faces the cam follower 26. In the state of FIGS. 6A1 and 6B1, the light path of the optical sensor 24 is blocked by the sensor flag member 23 in a manner similar to the state of FIGS. 5A2 and 5B2, as illustrated in FIG. 6B1.

When the sensor flag member 23 is pressed by the leading edge of the conveyed sheet and is rotated to a position where the apex of the rotary cam 23*g* exceeds the cam follower 26, the sensor flag member 23 rotates as follows. Rotating force generated by the rotary cam 23*g* and the pressing spring 27 allows the sensor flag member 23 to rotate in the counterclockwise direction that is the same as the rotating direction in which the sensor flag member 23 has been pressed and rotated by the leading edge of the sheet. Then, the sensor flag member 23 is in the state illustrated in FIGS. 6A2 and 6B2. In other words, the rotary cam 23*g* is shaped so that the direction of the urging force of the pressing spring 27 acting on the sensor flag member 23 changes while the sensor flag member 23 is being pressed and rotated by the leading edge of the sheet conveyed by the pair of conveying rollers 18 and 19.

FIGS. 6A2 and 6B2 illustrate a state where the sheet S is conveyed while the surface of the sheet conveyed by the pair of conveying rollers 18 and 19 is in contact with the sensor flag member 23. At this time, although rotating force that is counterclockwise in the figure is generated by the rotary cam 23*g* and the pressing spring 27 in the sensor flag member 23, the protrusion having the abutment surface in the sensor flag member 23 is in contact with the surface of the conveyed sheet S, so that the sensor flag member 23 is held. At this time, since the sheet S is conveyed while being stretched between the nips of the conveying driven rollers 18 and the driving rollers 19, the sheet S is conveyed such that the apparent stiffness of the sheet S is high.

After the trailing edge of the sheet passes the nips of the conveying driven rollers 18 and the driving rollers 19, the apparent stiffness of the sheet S is lowered. Accordingly, after the trailing edge of the sheet S passes the nips of the conveying driven rollers 18 and the driving rollers 19, the balance between the force of rotating the sensor flag member 23 caused by the urging force of the pressing spring 27 and the stiffness of the sheet (FIGS. 6A2 and 6B2) gradually becomes out of balance. The sensor flag member 23 is gradually rotated counterclockwise together with the rotary cam 23*g*. Specifically, while the trailing edge of the sheet S passes the sensor flag member 23 after the state of FIGS. 6A2 and 6B2, the balance between the stiffness of the sheet and the rotating force caused by the cam 23*g* and the pressing spring 27 gradually becomes out of balance. Accordingly, the sensor flag member 23 rotates, so that the sensor flag member 23 has a posture illustrated in FIGS. 7A1 and 7B1.

Referring to FIG. 7B1, when the trailing edge of the sheet S is moved away from the sensor flag member 23, the blocking of the light path of the optical sensor 24 by the sensor flag member 23 is released, so that the optical sensor 24 outputs an unblocking signal. In the present embodiment, the position of the trailing edge of the sheet S can be detected in accordance with the unblocking signal output from the optical sensor 24, as described above. The timing when the blocking of the light path of the optical sensor 24 is released may be set just after the trailing edge of the sheet S is away from the sensor flag member 23.

When the conveyance of the sheet further progresses after the state of FIGS. 7A1 and 7B1 such that the trailing edge of the sheet S is fully away from the sensor flag member 23, the sensor flag member 23 rotates as follows. The rotating force generated by the rotary cam 23*g* and the pressing spring 27 allows the sensor flag member 23 to rotate in the counter-clockwise direction that is the same as the rotating direction so far, so that the sensor flag member 23 is on standby in the steady position (abutment ready posture), as illustrated in FIGS. 7A2 and 7B2. Thus, preparation for detecting the next sheet S with the abutment surface 23*c* of the sensor flag member 23 is completed. As described above, since the abutment surface 23*c* is moved to the standby position while following the trailing edge of the sheet S, the sheet interval between the sheets can be remarkably reduced as compared with the related art.

The above-described states illustrated in FIGS. 4A to 7B2 are repeated each time a sheet is conveyed, so that the sensor flag member 23 rotates in the same direction. Each time one sheet S is fed, the abutment surface which the conveyed sheet abuts changes in the order of 23*a*, 23*c*, 23*e*, 23*a*, . . . . The sheet detecting device sequentially detects the positions of the leading edges of sheets which abut the abutment surfaces.

In the present embodiment, the interval between the time when the trailing edge of a preceding sheet S is away from the sensor flag member 23 and the time when the sensor flag member 23 rotates to the steady position for detecting the leading edge of a succeeding sheet S is short. Consequently, even when a plurality of sheets are fed at short sheet intervals and at high sheet conveying speed at which it has been difficult to detect a sheet in the related art, each sheet S can be detected. Thus, it is possible to meet user demands for further improved productivity related to sheet conveyance.

In the above-described present embodiment, the sensor flag member 23 has the three abutment surfaces. The number of abutment surfaces is not limited to three. FIGS. 9A to 9C illustrate a modification in which a structure has two abutment surfaces. FIGS. 10A to 10C illustrate another modification in which a structure has one abutment surface. FIGS. 9A and 10A each illustrate the shape of a rotary cam, FIGS. 9B and 10B each illustrate at least one abutment surface for a sheet S, and FIGS. 9C and 10C each illustrate a cam diagram and a signal of the optical sensor.

Referring to FIGS. 9A to 9C, each of states in positions indicated by a and b where the periphery of the rotary cam is in contact with the cam follower denotes the standby position of the sensor flag member 23. Positions aX and bX correspond to the apexes in which the radius of the rotary cam is the largest. The radius of the rotary cam gradually decreases from the position aX to the position b and from the position bX to the position a on the outer surface of the cam member. Referring to FIGS. 10A to 10C, a state in a position indicated by c where the periphery of the rotary cam is in contact with the cam follower denotes the standby position of the sensor flag member 23. A position cX corresponds to the apex in which the radius of the rotary cam is the largest. The radius of the rotary cam gradually decreases from the position cX to the position c on the outer surface of the cam member. Since an operation accompanying sheet conveyance is the same as that in the above-described case where the number of abutment surfaces is three, explanation thereof is omitted.

The case where the result of detection by the sheet detecting device 22 is used to obtain the timing of starting image formation through the image forming unit synchronously with the position of a conveyed sheet has been described above. The result of detection by the sheet detecting device 22 may be used as follows.

The structure may be designed as follows. First, image formation by the image forming unit is started. After that, sheet conveyance is controlled on the basis of the arrival of a sheet S detected by the sheet detecting device 22 so that the position of the sheet corresponds to each formed image. In addition, a sheet conveyance failure, such as a jam, can be determined on the basis of sheet detection by the sheet detecting device (output from the optical sensor). Furthermore, a sheet detecting device having the same structure as that of the above-described sheet detecting device is disposed between the fixing unit 10 and the pair of discharge rollers 11 and 12. To convey a sheet to the duplex conveying path 15 by the pair of discharge rollers 11 and 12, the timing of reversing the pair of discharge rollers 11 and 12 is controlled on the basis of the result of detection by the sheet detecting device. As described above, the result of detection by the sheet detecting device can be used to determine the timing of reversing the pair of rollers for reverse conveyance.

Second Embodiment

A sheet detecting device and an image forming apparatus including the same according to a second embodiment of the present invention will be described with reference to FIGS. 11A to 13. Only a different portion from the first embodiment will be described. The same components (functions) as those in the first embodiment are designated by the same reference numerals and explanation thereof is omitted.

Figure 11A:
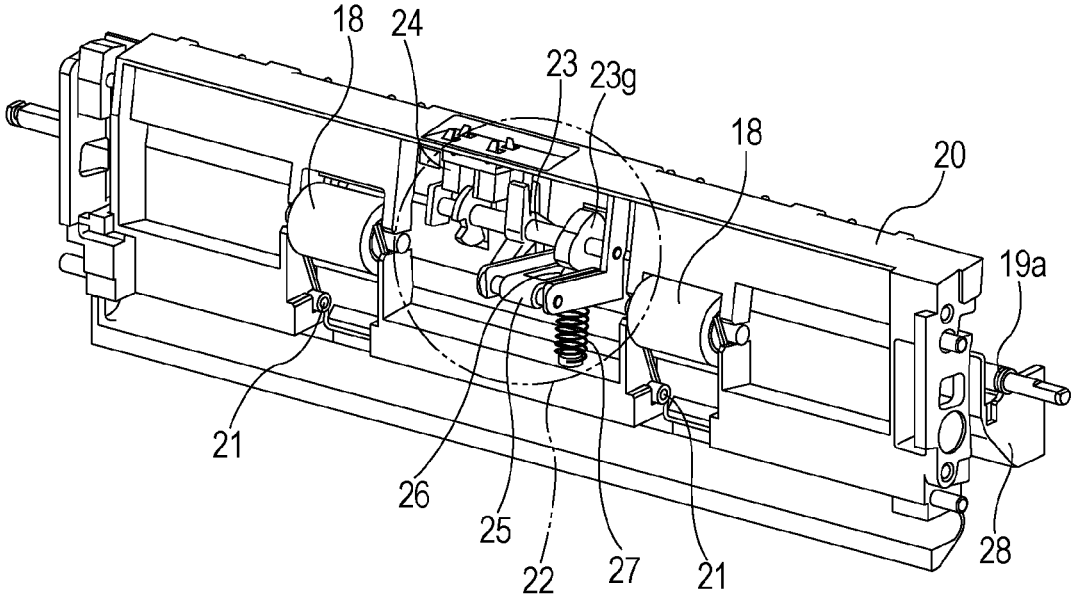
FIGS. 11A and 11B are perspective views illustrating the structure of a sheet detecting device according to a second embodiment.
Figure 11B:
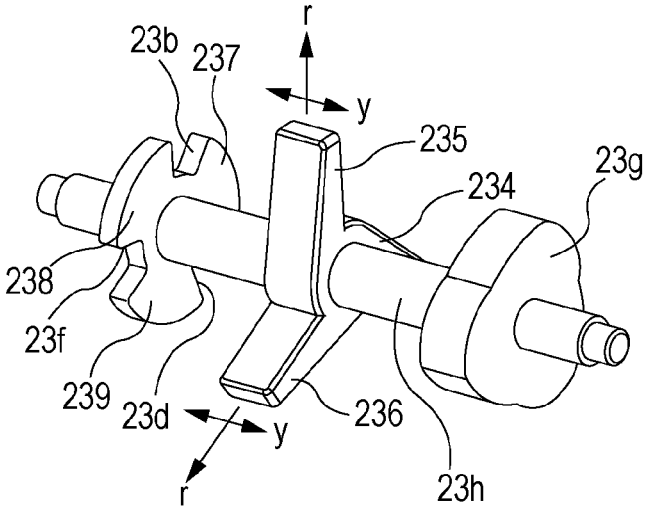
Figure 12A:
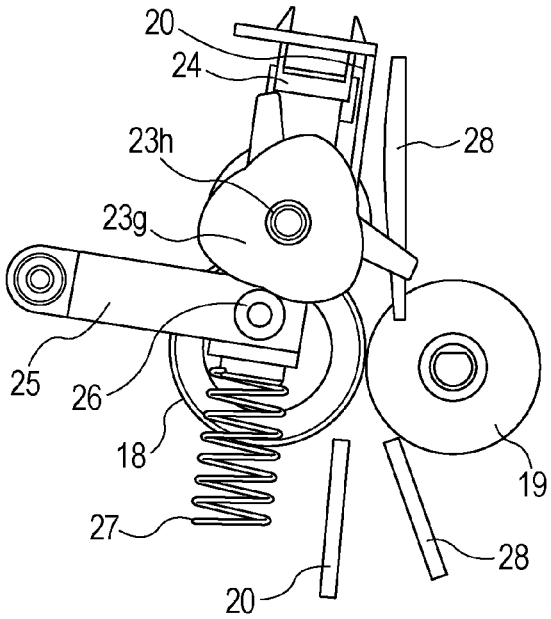
FIGS. 12A to 12C are cross-sectional views illustrating an operation of the sheet detecting device according to the second embodiment.
Figure 12B:
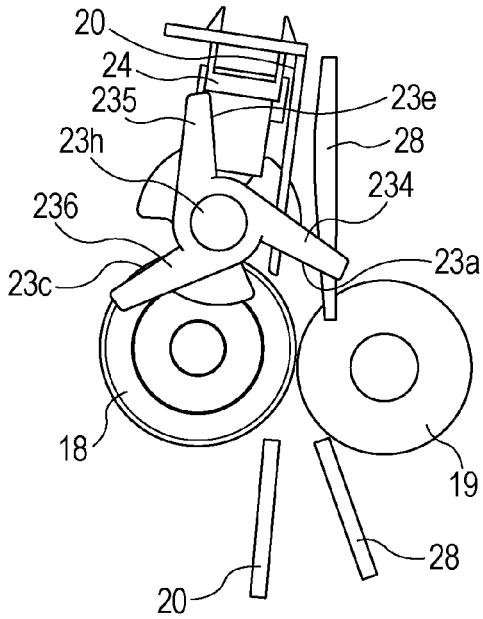
Figure 12C:
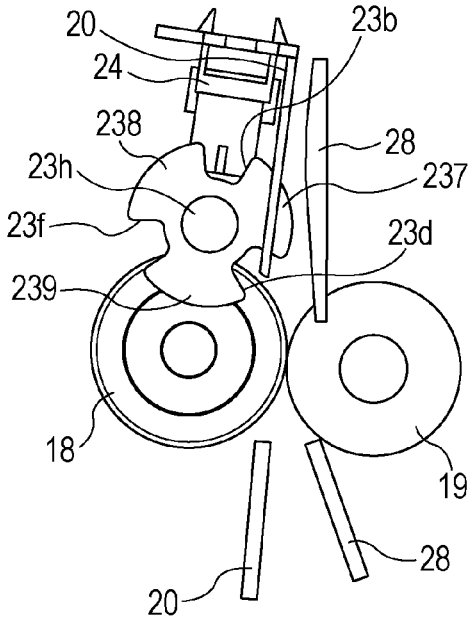

The structure according to the second embodiment will be first described. FIG. 11A is a perspective view illustrating the structure of the sheet detecting device according to the second embodiment. FIG. 11B is a perspective view of only the sensor flag member 23. FIGS. 12A to 12C are cross-sectional views of the sheet detecting device 22. FIG. 12A is a diagram explaining the rotary cam 23*g*, FIG. 12B is a diagram explaining the abutment surfaces 23*a*, 23*c*, and 23*e*, and FIG. 12C is a diagram explaining light-shielding portions 237, 238, and 239.

In the first embodiment, the abutment surfaces 23*a*, 23*c*, and 23*e* which the leading edges of sheets are to abut and the light-shielding edges 23*b*, 23*d*, and 23*f* are included in the protrusions 231, 232, and 233 protruding from the rotation shaft perpendicular to the rotation shaft. On the other hand, according to this second embodiment, as illustrated in FIG. 11B, protrusions 234, 235, and 236 having the abutment surfaces 23*a*, 23*c*, and 23*e* are arranged separately from the light-shielding portions 237, 238, and 239 configured to block the light path of the optical sensor 24 such that the protrusions are shifted from the light-shielding portions in the axial direction.

Specifically, the protrusions 234, 235, and 236 having the abutment surfaces 23*a*, 23*c*, and 23*e* which the leading edges of sheets are to abut radially protrude from the rotation shaft 23*h*. In addition, the light-shielding portions 237, 238, and 239 radially protrude from the rotation shaft 23*h* such that the portions are located at different positions from the protrusions 234, 235, and 236 in the axial direction of the rotation shaft 23*h*. The outer edges of the light-shielding portions 237, 238, and 239 serve as the light-shielding edges 23*b*, 23*d*, and 23*f*, respectively.

Since an operation accompanying sheet conveyance in the second embodiment is the same as that in the first embodiment, explanation thereof is omitted.

In the first embodiment, the abutment surfaces 23*a*, 23*c*, and 23*e* and the light-shielding edges 23*b*, 23*d*, and 23*f* provided for the sensor flag member 23 are arranged in the same position in the axial direction. Accordingly, the first embodiment has an advantage in that a space for disposing the sheet detecting mechanism can be reduced. However, the shape of each of the abutment surfaces 23*a*, 23*c*, and 23*e* in the sensor flag member 23 is restricted in order to take the positional relationship with the light path of the optical sensor 24 and avoid the interference between the optical sensor 24 and the sensor flag member 23.

In the sensor flag member 23 according to this second embodiment, the protrusions 234, 235, and 236 having the abutment surfaces 23*a*, 23*c*, and 23*e* of the sensor flag member 23 and the light-shielding portions 237, 238, and 239 protrude in different positions in the axial direction. Accordingly, the abutment surfaces 23*a*, 23*c*, and 23*e* of the sensor flag member 23 may be designed out of consideration of the positional relationship with the light path of the optical sensor 24. The flexibility of designing the shape of each of the abutment surfaces 23*a*, 23*c*, and 23*e* of the sensor flag member 23 can be increased.

Specifically, as illustrated in FIG. 11B, in the sensor flag member 23 according to the second embodiment, the width, indicated by the arrow y in the direction perpendicular to the sheet conveying direction, of each of the protrusions 234, 235, and 236 having the abutment surfaces 23*a*, 23*c*, and 23*e* can be increased. As for the abutment surface 23*a*, the length in the radial direction, indicated by the arrow r, about the rotation shaft 23*h* can also be increased.

Figure 13:
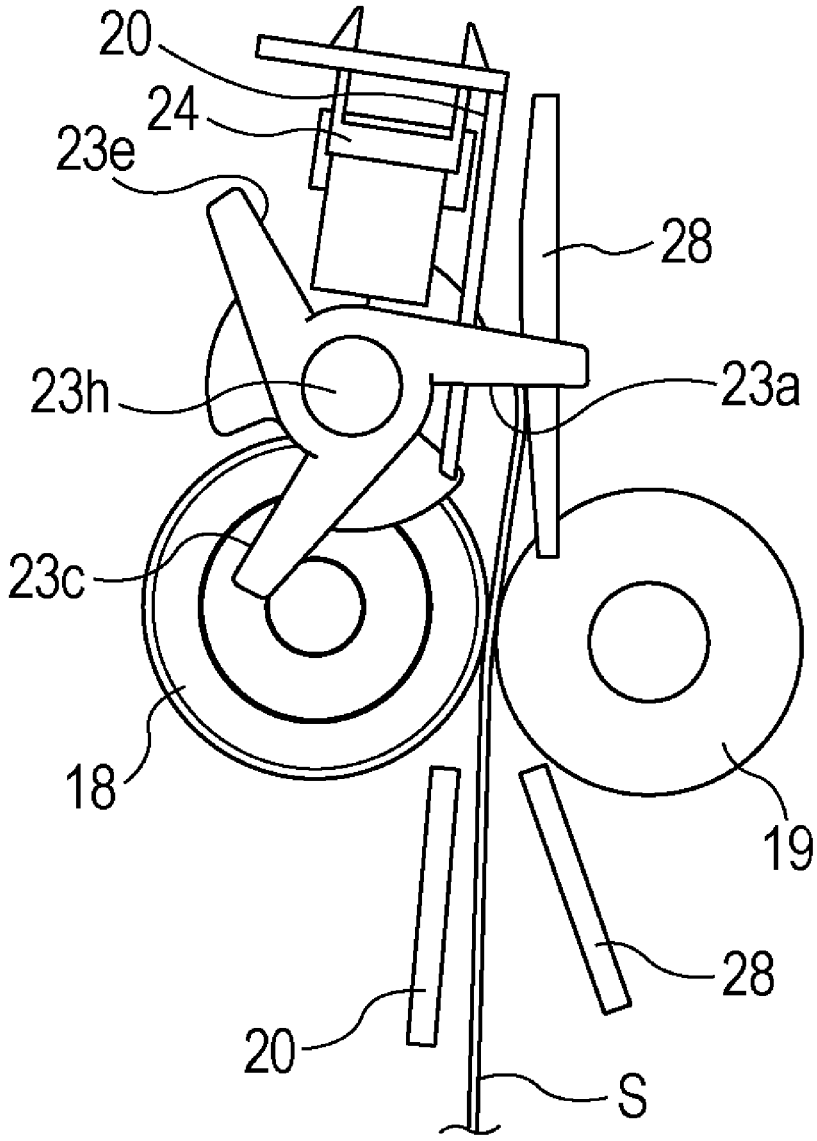
FIG. 13 is a diagram explaining the operation of the sheet detecting device according to the second embodiment.

When the leading edge of a sheet S conveyed by the pair of conveying rollers 18 and 19 is pressed against the abutment surface 23*a* of the sensor flag member 23, as illustrated in FIG. 13, the leading edge of the sheet S is applied with pressing force caused by reaction force of holding force of the rotary cam 23*g* urged by the pressing spring 27.

In this second embodiment, the width of each of the abutment surfaces 23*a*, 23*c*, and 23*e* in the direction indicated by the arrow y (refer to FIG. 11B) is increased. Accordingly, contact pressure caused when the leading edge of a sheet S abuts the abutment surface 23*a* of the sensor flag member 23 can be reduced. Consequently, the effect of preventing a trace of the abutment surface from being left on the leading edge of the sheet S can be expected.

In addition, the length of the abutment surface 23*a* in the radial direction, indicated by the arrow r, about the rotation shaft 23*h* is increased, so that the amount of protrusion of the abutment surface 23*a* of the sensor flag member 23 to the guide frame 28 is increased. Consequently, this prevents the leading edge of the sheet S from slipping away from the abutment surface 23*a*. The sensor flag member 23 can be more reliably rotated by the leading edge of the sheet S.

Figure 14A:
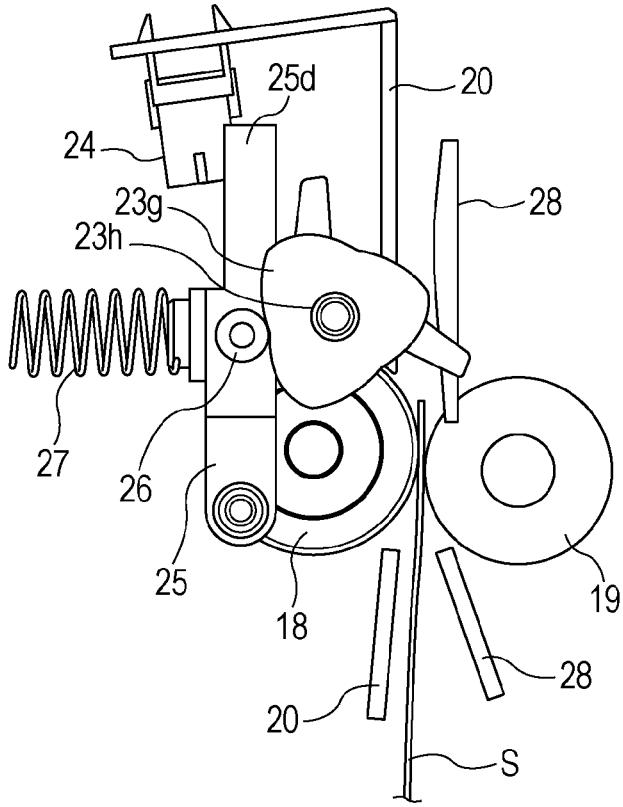
FIGS. 14A and 14B are explanatory diagrams explaining a modification of the second embodiment.
Figure 14B:
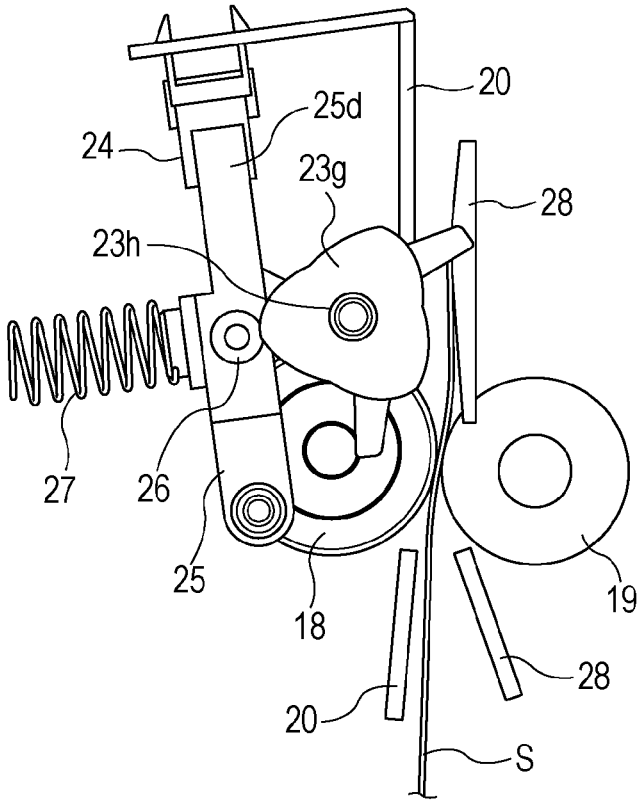

The light-shielding edges 23*b*, 23*d*, and 23*f* are configured to detect the rotation of the sensor flag member 23 together with the optical sensor 24 and detect the position of a sheet. The light-shielding edges 23*b*, 23*d*, and 23*f* do not always have to be integrated with the sensor flag member 23, as described in the present embodiment. In other words, the member blocking the light path of the optical sensor 24 may be a member which is different from the sensor flag member 23 and is operatively associated with the rotation position of the sensor flag member 23. FIGS. 14A and 14B illustrate such a modification.

According to the modification of FIGS. 14A and 14B, an end 25*d* of the pressing member 25 including the cam follower 26 in contact with the rotary cam 23*g* functions as a light-shielding portion for blocking the light path of the optical sensor 24.

In the steady position illustrated in FIG. 14A, the position of the pressing member 25 located through the cam follower 26 in contact with the rotary cam 23*g* is set so that the end 25*d* of the pressing member 25 unblocks the light path of the optical sensor 24. Referring to FIG. 14B, when the pressing member 25 is swung through the cam follower 26 in contact with the rotary cam 23*g* rotated while being pressed by a conveyed sheet S, the end 25*d* of the pressing member 25 blocks the light path of the optical sensor 24.

The operations and advantages in the above-described first and second embodiments will be collectively described below.

The holding force of holding the sensor flag member 23 in the steady position is generated through the rotary cam 23*g* by the pressing spring 27, serving as an urging portion. After a sheet passage posture (FIGS. 6A2 and 6B2) of the sensor flag member 23, when the trailing edge of a sheet passes the sensor flag member 23, the sensor flag member 23 is rotated in the sheet conveying direction by the urging force of the pressing spring 27, so that the sensor flag member 23 returns to the steady position (FIGS. 7A2 and 7B2) where the sensor flag member 23 has an abutment posture. Therefore, the interval between the time when the trailing edge of the sheet passes the sensor flag member 23 and the time when the sensor flag member 23 returns to the steady position is short. Advantageously, the productivity (the number of conveyed sheets per unit time) related to sheet conveyance can be increased.

In order to rotate the sensor flag member 23 from the state (FIGS. 6A1 and 6B1) where the sensor flag member 23 is rotated by a predetermined amount after the leading edge of a sheet is come into contact with the sensor flag member 23 to the sheet passage posture (FIGS. 6A2 and 6B2) where the sensor flag member 23 is in contact with the surface of the sheet, the spring force of the pressing spring 27 is used. In addition, to rotate the sensor flag member 23 from the sheet passage posture where the sensor flag member 23 is in contact with the surface of the sheet to the steady position (FIGS. 7A2 and 7B2), the spring force of the pressing spring 27 is similarly used. Accordingly, the structure is simple and reasonable.

Third Embodiment

A sheet detecting device and an image forming apparatus including the same according to a third embodiment of the present invention will be described with reference to FIGS. 15A to 17. Only a different portion from the second embodiment will be described. The same components (functions) as those in the second embodiment are designated by the same reference numerals and explanation thereof is omitted.

Figure 15A:
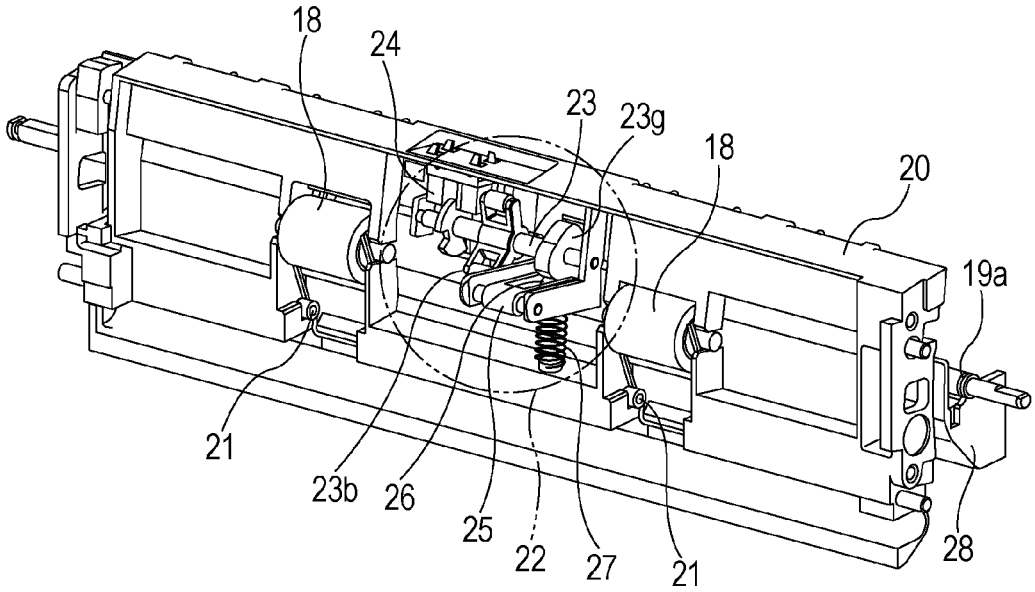
FIGS. 15A and 15B are perspective views illustrating the structure of a sheet detecting device according to a third embodiment.
Figure 15B:
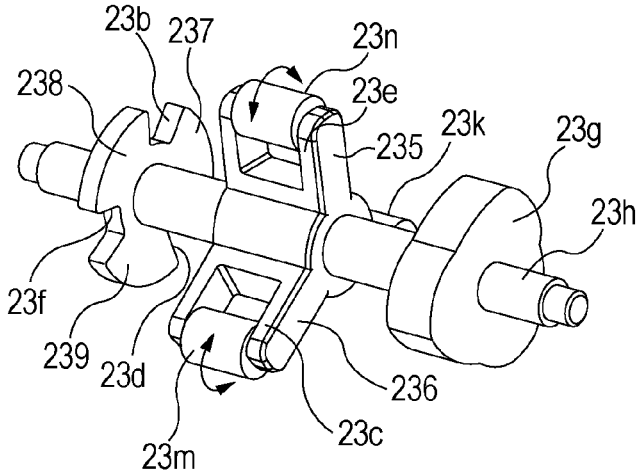
Figure 16A:
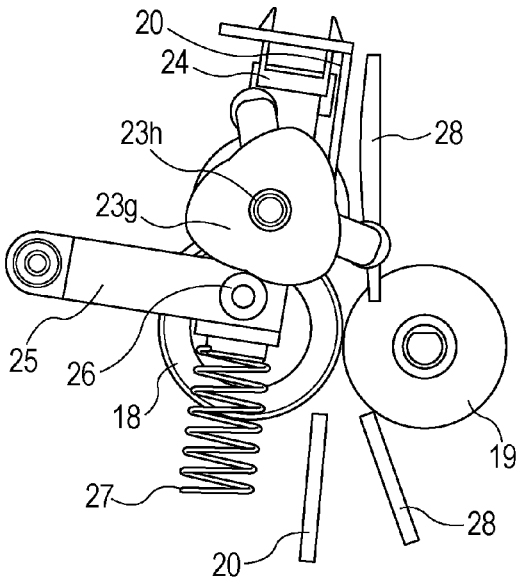
FIGS. 16A to 16C are cross-sectional views illustrating an operation of the sheet detecting device according to the third embodiment.
Figure 16B:
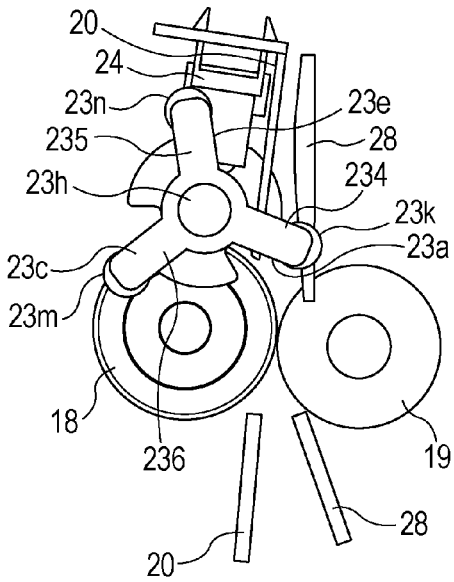
Figure 16C:
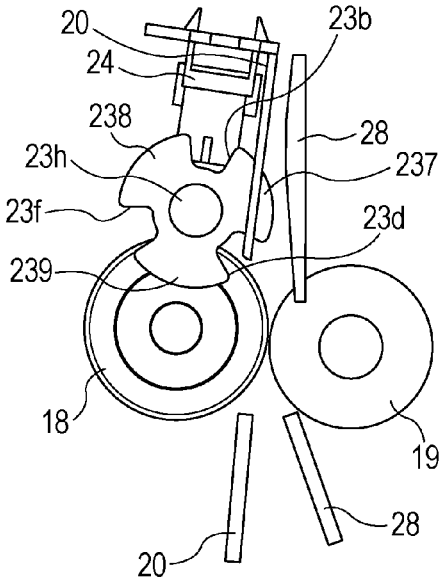

FIG. 15A is a perspective view illustrating the structure according to the third embodiment. FIG. 15B is a perspective view of only the sensor flag member 23 according to the third embodiment. FIGS. 16A to 16C illustrate the cross sections of the sheet detecting device 22. FIG. 16A is a diagram explaining the rotary cam 23*g*, FIG. 16B is a diagram explaining the abutment surfaces 23*a*, 23*c*, and 23*e*, and FIG. 16C is a diagram explaining the light-shielding portions 237, 238, and 239.

In the third embodiment, as illustrated in FIGS. 15A to 16C, flag driven rollers 23*k*, 23*m*, and 23*n* to be come into contact with the surface of a conveyed sheet are rotatably attached to the sensor flag member 23. The flag driven rollers 23*k*, 23*m*, and 23*n*, serving as driven rotary members, are provided for the ends of the protrusions 234, 235, and 236 having the abutment surfaces 23*a*, 23*c*, and 23*e*, respectively. The flag driven rollers 23*k*, 23*m*, and 23*n* are rotatably attached to the sensor flag member 23, as indicated by the arrows in FIG. 15B.

Since a fundamental operation accompanying sheet conveyance in the third embodiment is the same as that in the first embodiment or the second embodiment, explanation thereof is omitted. An operation peculiar to the third embodiment will be described below.

Figure 17:
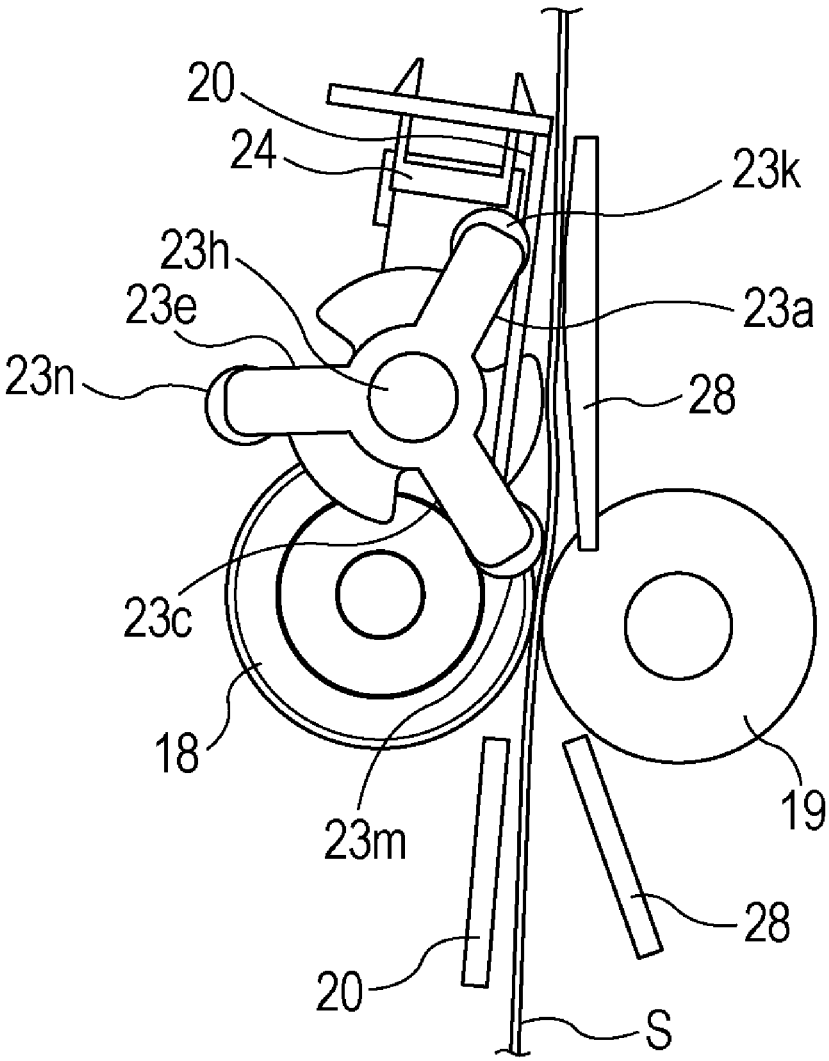
FIG. 17 is a diagram explaining the operation of the sheet detecting device according to the third embodiment.

FIG. 17 illustrates a state where a sheet S is conveyed through the pair of conveying rollers 18 and 19 after the leading edge of the sheet passes the sensor flag member 23. Although rotating force is generated in the sensor flag member 23 by the rotary cam 23*g* and the pressing spring 27, the sensor flag member 23 is held such that the rotating force and the stiffness of the sheet S are kept in balance.

In this case, any of the flag driven rollers 23*k*, 23*m*, and 23*n* provided for the ends of the sensor flag member 23 is come into contact with the surface of the conveyed sheet. Since any of the flag driven rollers 23*k*, 23*m*, and 23*n* is rotated by the conveyed sheet S, the contact resistance of the sensor flag member 23 with the sheet is reduced. Accordingly, a trace, caused by the contact between the sensor flag member 23 and the surface of a sheet S, left on the surface of the sheet can be reduced.

In particular, if the pair of conveying rollers 18 and 19 is arranged downstream of the fixing unit and any of the abutment surfaces 23*a*, 23*c*, and 23*e* is come into contact with a toner image surface with toner images after fixing, the larger effects can be expected.

Fourth Embodiment

A sheet detecting device and an image forming apparatus including the same according to a fourth embodiment related to the present invention will be described with reference to FIGS. 18 to 20. Only a different portion from the first embodiment will be described. The same components as those in the first embodiment are designated by the same reference numerals and explanation thereof is omitted.

Figure 18:
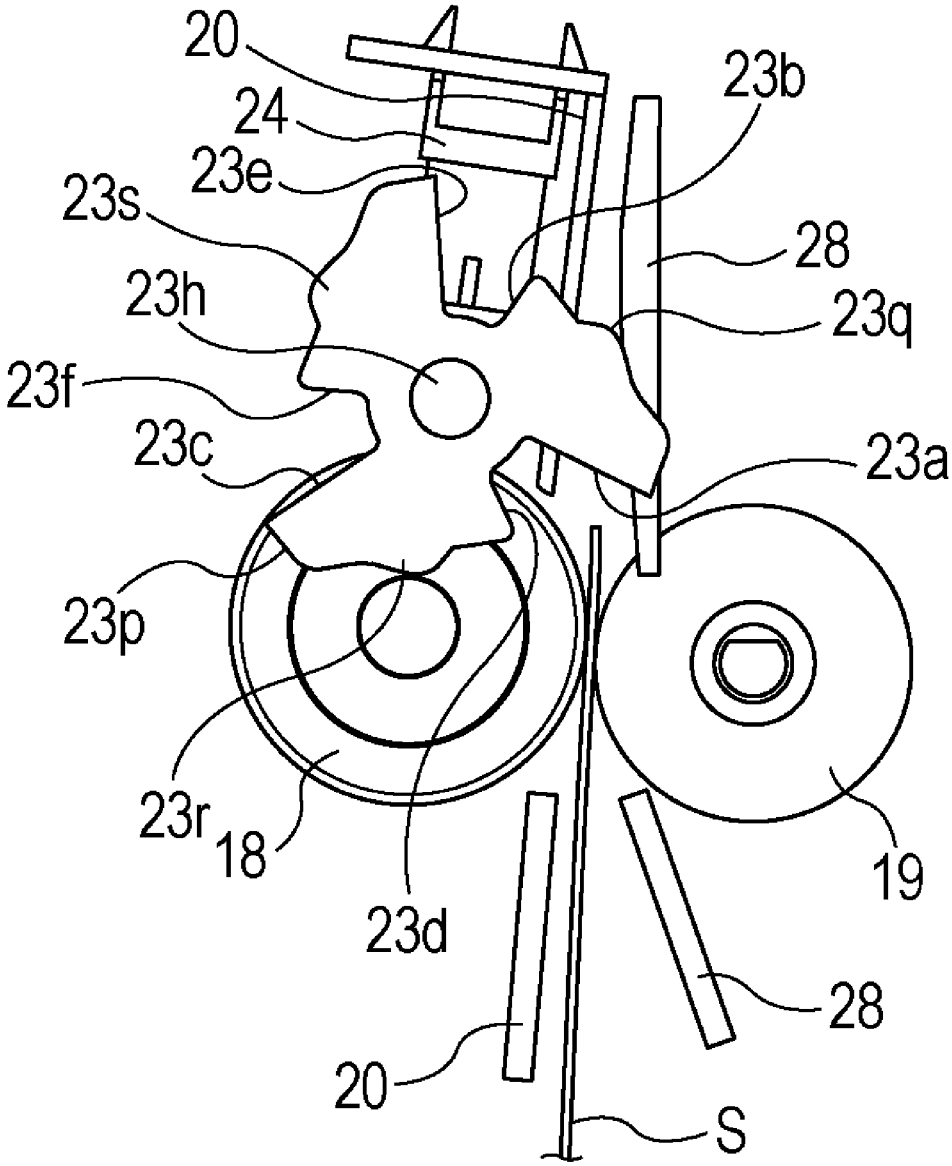
FIG. 18 is a diagram explaining an operation of a sheet detecting device according to a fourth embodiment.

FIG. 18 is a diagram illustrating the structure according to the fourth embodiment and depicts the cross section of the sheet detecting device. In the fourth embodiment, a projection 23*q* is provided upstream of the abutment surface 23*a* of the sensor flag member 23 in the rotating direction. Similarly, a projection 23*r* is provided upstream of the abutment surface 23*c* in the rotating direction and a projection 23*s* is provided upstream of the abutment surface 23*e* in the rotating direction. As for the amount of projection of each of the projections 23*q*, 23*r*, and 23*s* in the radial direction, the projection amount is smaller than that of the portion protruding so as to have the abutment surface, serving as the outermost part of the sensor flag member 23.

Figure 19A:
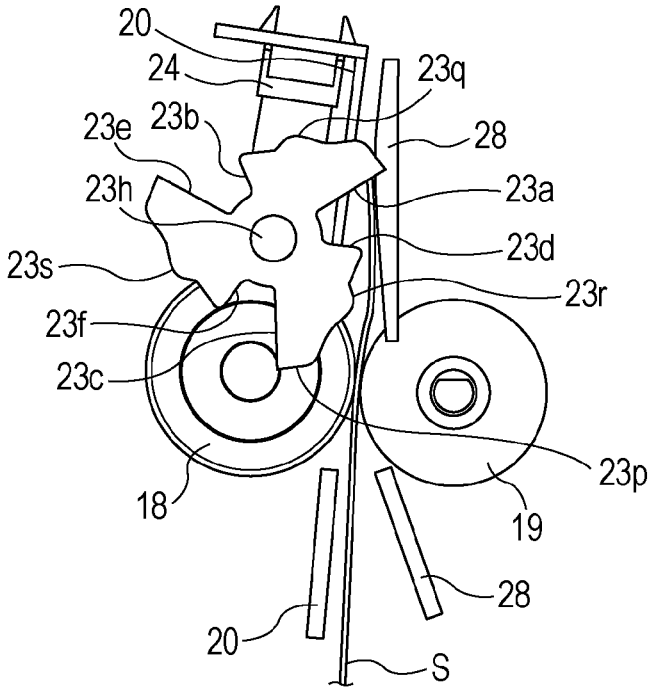
FIGS. 19A and 19B are diagrams explaining the operation of the sheet detecting device according to the fourth embodiment.
Figure 19B:
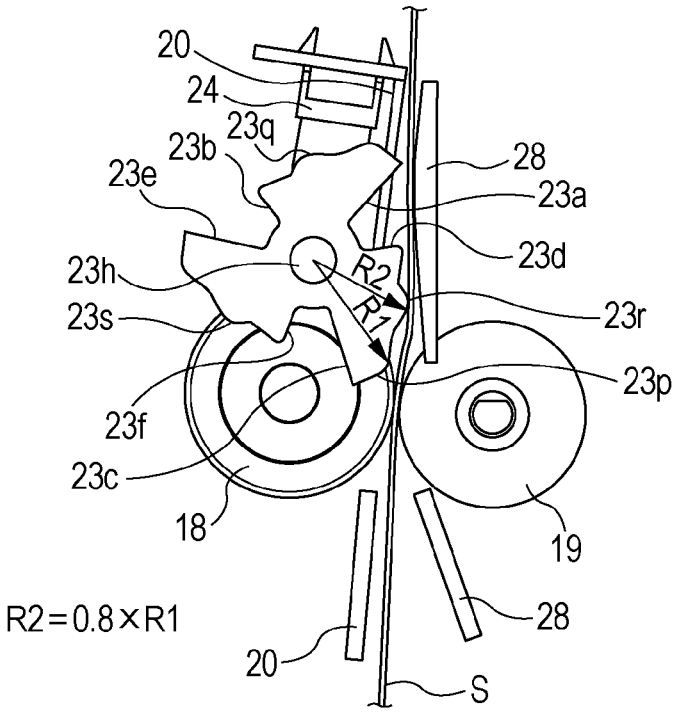

An operation according to the fourth embodiment will be described with reference to FIGS. 18, 19A, and 19B. FIGS. 18, 19A, and 19B illustrate the cross sections of the sheet detecting device according to the present embodiment. FIGS. 18, 19A, and 19B illustrate states where a sheet is conveyed in the sheet conveying direction in that order.

FIG. 18 is a diagram illustrating the state just before the leading edge of a sheet S abuts the abutment surface 23*a* of the sensor flag member 23. FIG. 19A illustrates the state where the sheet S is further conveyed through the pair of conveying rollers 18 and 19 after the leading edge of the sheet S abuts the abutment surface 23*a*. At this time, a contact portion of the sensor flag member 23 with the sheet S is only the abutment surface 23*a*. The projection 23*r* is not in contact with the sheet S.

Subsequently, when the sensor flag member 23 is rotated due to rotating force generated by the rotary cam 23*g* and the pressing spring 27, as illustrated in FIG. 19B, the projection 23*r* in the sensor flag member 23 is come into contact with the surface of the sheet S. The contact between the projection 23*r* and the surface of the sheet is held until the trailing edge of the sheet S passes the projection 23*r*. After the trailing edge of the sheet S passes the projection 23*r*, the sensor flag member 23 is rotated to the steady position, illustrated in FIG. 18, by the rotating force generated by the rotary cam 23*g* and the pressing spring 27 in a manner similar to the first embodiment. Thus, preparation for detecting the next sheet is completed. The above-described operation is repeated each time one sheet is conveyed. The projections 23*s* and 23*q* are sequentially come into contact with the surfaces of sheets S such that the contact accompanies the passage of one sheet. Light-shielding portions may be provided separately from the protrusions having the abutment surfaces 23*a*, 23*c*, and 23*e*, as described in the second embodiment.

The effects of the projections 23*q*, 23*r*, and 23*s* in the fourth embodiment will be described. Providing the projections can reduce a contact sound caused when the sensor flag member 23 is come into contact with the surface of a sheet S after the leading edge of the sheet abuts the abutment surface 23*a* of the sensor flag member 23 and the sensor flag member 23 is rotated by the rotating force of the rotary cam 23*g*. This factor will be described in detail below.

In the first embodiment, when the sensor flag member 23 is rotated due to the action of the rotary cam 23*g*, a contact portion of the sensor flag member 23 with the sheet S corresponds to an end 23*p* of the sensor flag member 23 located on the opposite side of the abutment surface which the sheet S abuts, as illustrated in FIG. 6B2. In this instance, let R1 denote a contact radius from the contact portion of the sensor flag member 23 with the surface of the sheet S to the center of rotation of the sensor flag member 23. Let w1 denote an angular velocity of the sensor flag member 23 when the surface of the sheet S is come into contact with the contact portion of the sensor flag member 23. A velocity V1 when the sensor flag member 23 is come into contact with the surface of the sheet S is $V1=R1\cdot\omega1$.

When the contact portion with the sheet S corresponds to the end 23*p* where the radius of the sensor flag member 23 is the largest, the fastest portion of the sensor flag member 23 is come into contact with the sheet S. On the other hand, in the fourth embodiment, the contact portion of the sensor flag member 23 with the sheet S corresponds to the projection 23*r*. Let R2 denote a contact radius from the contact portion of the sensor flag member 23 with the sheet S to the center of rotation of the sensor flag member 23. Let ω2 denote an angular velocity of the sensor flag member 23 when the contact portion of the sensor flag member 23 is come into contact with the surface of the sheet S. A velocity V2 when the sensor flag member 23 is come into contact with the sheet S is $V2=R2-\omega2$.

In this case, as illustrated in FIG. 19B, the contact radius in the fourth embodiment is the contact radius R2 which is smaller than R1 in the case where the projection is not provided. In this fourth embodiment, the structure is designed so as to satisfy the relationship of $R2=0.8\times R1$.

The relationship with the angular velocity of the sensor flag member 23 will now be described with reference to FIG. 20. FIG. 20 is a diagram illustrating the relationship among the rotation phase of the rotary cam 23*g*, the angular velocity of the sensor flag member 23 at that time, and the radius of the rotary cam 23*g*. FIG. 20 also depicts the movement of the rotary cam in the first embodiment (first embodiment) for comparison.

Figure 20:
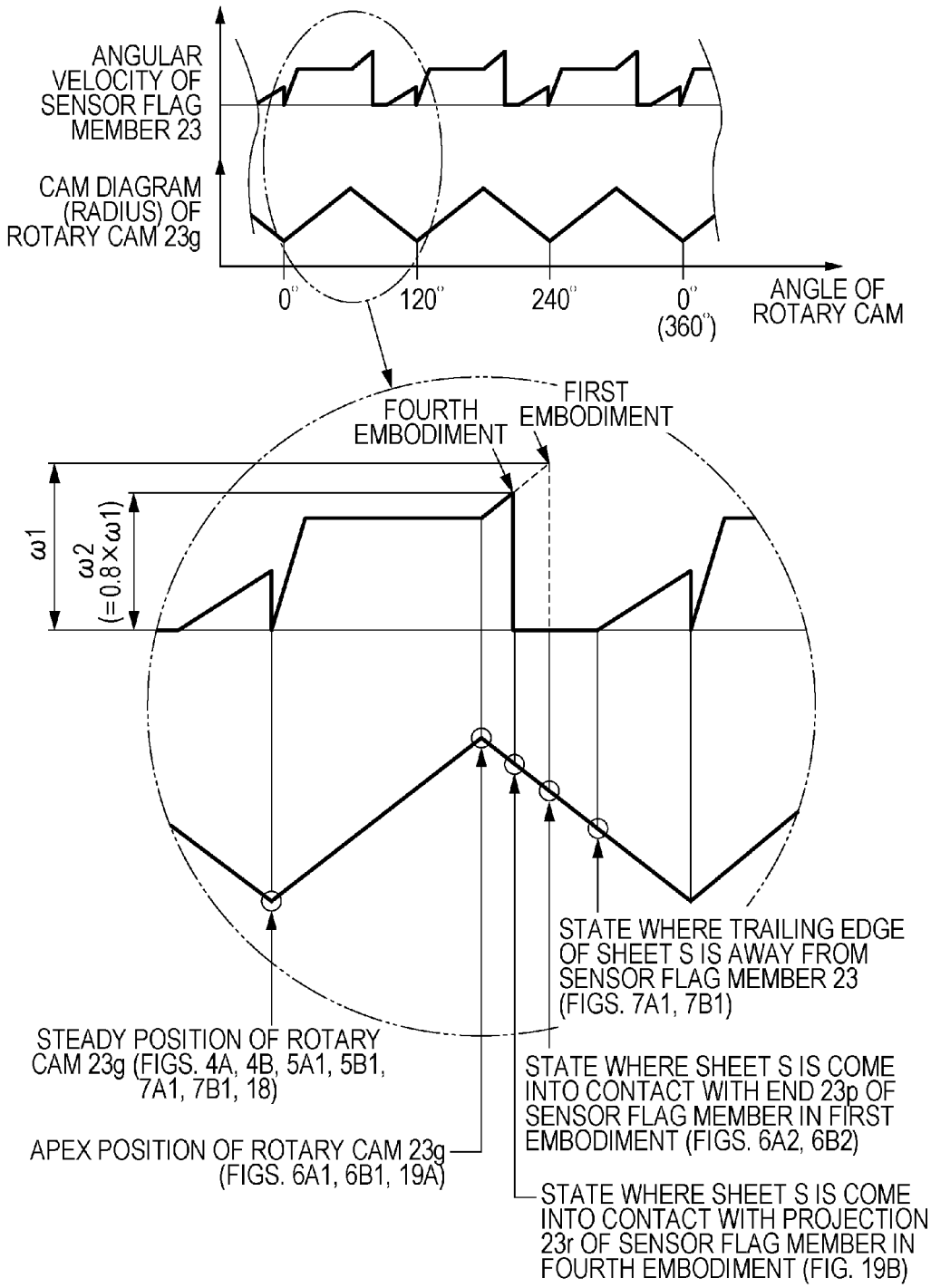
FIG. 20 includes a cam diagram of the sheet detecting device according to the fourth embodiment and an explanatory diagram illustrating an angular velocity of a sensor flag member.

Referring to FIG. 20, the angle of rotation from the apex position of the rotary cam 23*g* to the position where the sensor flag member 23 is come into contact with the sheet S in the fourth embodiment (FIG. 19B) is smaller than that in the first embodiment (FIG. 6B2). The relationship of the angular velocities of the sensor flag member 23 at this time is expressed as $\omega2<\omega1$. In the fourth embodiment, $\omega2=0.8\times\omega1$.

Accordingly, the relationship of the contact velocities of the sensor flag member 23 when being come into contact with the surface of the sheet is $V2<V1$. In the present embodiment, the velocity V2 is 64% of the velocity V1 ($V2=0.8\cdot R1\times 0.8\cdot\omega1=0.64V1$). Contact energy E when the sensor flag member 23 is come into contact with the sheet S by the rotating force of the rotary cam 23*g* is proportional to the square of the contact velocity. Therefore, the relationship between contact energy E1 in the first embodiment and contact energy E2 in the fourth embodiment is $E2=0.41\cdot E1$. Further providing the projections can reduce the contact energy by about 60% as compared with the first embodiment. As the contact energy decreases, a contact sound also decreases. In an experiment under the above-described conditions, the contact sound was 58 dB in the first embodiment and that was 53 dB in the fourth embodiment. Advantageously, the contact sound could be reduced by 5 dB.

As described above, according to the present embodiment, since the sensor flag member 23 has the projections 23*q*, 23*r*, and 23*s*, a contact sound caused when the sensor flag member 23 is come into contact with the surface of a sheet S can be reduced. Consequently, the image forming apparatus that is quiet and has improved productivity can be provided to a user.

The structure according to the present embodiment is made such that the projections 23*q*, 23*r*, and 23*s* are integrated with the sensor flag member 23. The projections 23*q*, 23*r*, and 23*s* may be separated members and be coupled with the sensor flag member 23 through elastic members, such as springs. Assuming that the projections 23*q*, 23*r*, and 23*s*, serving as contact portions of the sensor flag member 23, are separated members, if the separated members are rotatable driven rollers (e.g., the flag driven rollers 23*k*, 23*m*, and 23*n* described in the third embodiment), a conveyed sheet S is come into rolling contact with the driven rollers, serving as the contact portions. Accordingly, the sheet is not rubbed against any of the projections 23*q*, 23*r*, and 23*s* of the sensor flag member 23. Advantageously, a trace of the contact portion left on the sheet S can be reduced in a manner similar to the third embodiment.

Figure 21:
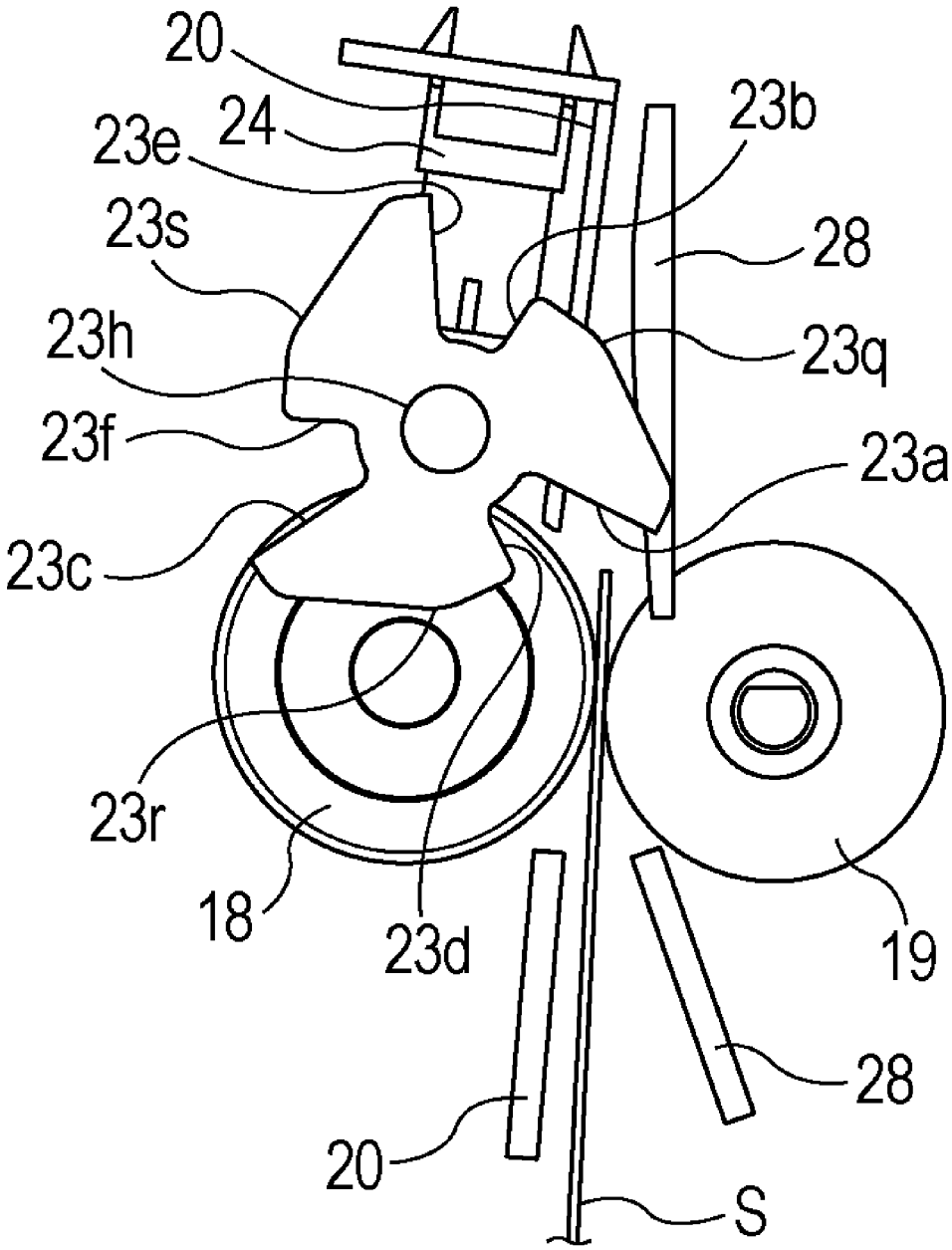
FIG. 21 is an explanatory diagram explaining a modification of the fourth embodiment.
Figure 22A:
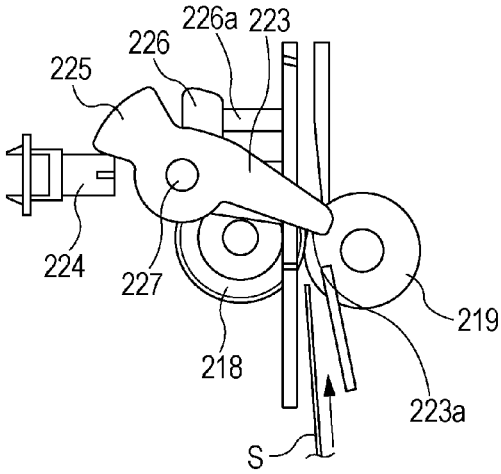
FIGS. 22A to 22C are diagrams explaining a related art.
Figure 22B:
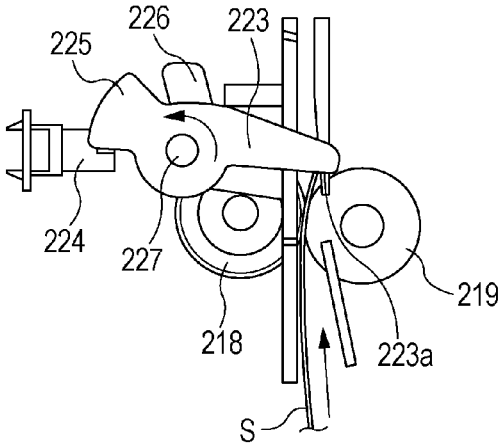
Figure 22C:
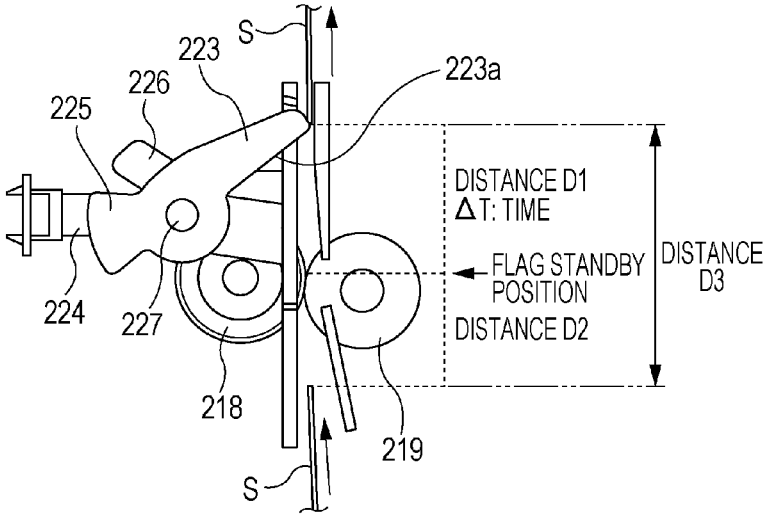

As for the projections, if each projection is gradually tapered to the end of the sensor flag member 23 as illustrated in FIG. 21, the same advantages can be obtained.

According to the present invention of this application, there can be provided a sheet detecting device capable of detecting a sheet even if sheet conveying speed is high and the interval between sheets is short.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/068079, filed Oct. 20, 2009, which is hereby incorporated by reference herein in its entirety.

Reference Signs List

18 conveying driven roller
19 conveying driving roller
23 sensor flag member
24 optical sensor
25 pressing member
26 cam follower
27 pressing spring

The invention claimed is:

1. A sheet detecting device comprising:

a rotation unit having an abutment surface, the rotation unit being pressed and rotated in a rotating direction by the leading edge of a conveyed sheet when the leading edge of the conveyed sheet abuts the abutment surface;

a positioning unit configured to position the rotation unit in a standby position where the leading edge of the conveyed sheet abuts the abutment surface; and a detecting unit configured to detect the conveyed sheet on the basis of the rotation of the rotation unit pressed by the conveyed sheet, wherein the rotation unit rotates to a sheet passage posture where the sheet is allowed to pass after being pressed by the leading edge of the conveyed sheet and, when the trailing edge of the conveyed sheet passes the rotation unit, the rotation unit is rotated from the sheet passage posture in the rotating direction and is positioned in the standby position.

2. The device according to claim 1, wherein when the leading edge of the sheet abuts the abutment surface of the rotation unit to rotate the rotation unit, the rotation unit is rotated in the rotating direction, the rotation unit in the sheet passage posture is in contact with the surface of the conveyed sheet, and the rotation unit is further rotated from the sheet passage posture to the standby position in the rotating direction while following the trailing edge of the conveyed sheet.

3. The device according to claim 2, wherein the positioning unit comprises a cam provided for a rotation shaft of the rotation unit, and an urging portion configured to urge the cam, wherein the cam is shaped so that the direction in which urging force of the urging portion acts on the rotation unit changes to the direction in which the rotation unit is rotated in the rotating direction while the rotation unit is being pressed and rotated by the leading edge of the conveyed sheet.

4. The device according to claim 1, further comprising:

a pair of rotary members configured to convey the sheet so that the sheet abuts the abutment surface of the rotation unit, wherein when the rotation unit is in the sheet passage posture, the rotation unit comes into contact with the surface of the sheet conveyed by the pair of rotary members.

5. The device according to claim 4, wherein the rotation unit is provided with a driven rotary member that is driven and rotated by the conveyed sheet.

6. The device according to claim 1, wherein the detecting unit includes an optical sensor, the rotation unit includes a rotation shaft and a protrusion protruding from the rotation shaft in the radial direction, and the protrusion has the abutment surface and blocks a light path of the optical sensor.

7. The device according to claim 1, wherein the detecting unit includes an optical sensor, and the rotation unit includes a rotation shaft, a protrusion protruding from the rotation shaft in the radial direction and having the abutment surface, and a light-shielding portion protruding from the rotation shaft in the radial direction in a different position from that of the protrusion in the axial direction to block a light path of the optical sensor.

8. The device according to claim 1, wherein the rotation unit has a plurality of abutment surfaces in the circumferential direction, and the rotation unit is rotated in the sheet conveying direction from the standby position where the leading edge of the sheet abuts one of the abutment surfaces and is positioned in the standby position where the leading edge of the next sheet abuts another one of the abutment surfaces.

9. The device according to claim 1, wherein a contact portion of the rotation unit in the sheet passage posture is in contact with the surface of the conveyed sheet, and the contact portion is a projection located inward relative to the outermost portion of the rotation unit in the radial direction of the rotation unit.

10. An image forming apparatus comprising:

the sheet detecting device according to claim 1; and an image forming unit configured to form an image onto a sheet detected by the sheet detecting device.

* * * * *